US010311846B2

(12) United States Patent
Tanoue et al.

(10) Patent No.: US 10,311,846 B2
(45) Date of Patent: Jun. 4, 2019

(54) KEYBOARD MUSICAL INSTRUMENT AND METHOD OF ACQUIRING CORRECTION INFORMATION IN KEYBOARD MUSICAL INSTRUMENT

(71) Applicant: YAMAHA CORPORATION, Hamamatsu-shi (JP)

(72) Inventors: Michiko Tanoue, Hamamatsu (JP); Ichiro Osuga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/969,080

(22) Filed: May 2, 2018

(65) Prior Publication Data

US 2018/0247628 A1 Aug. 30, 2018

Related U.S. Application Data

(63) Continuation of application No. PCT/JP2016/083005, filed on Nov. 1, 2016.

(30) Foreign Application Priority Data

Nov. 4, 2015 (JP) ..... 2015-216746

(51) Int. Cl.
*G10H 1/02* (2006.01)
*G10H 1/18* (2006.01)
(Continued)

(52) U.S. Cl.
CPC ..... *G10H 1/344* (2013.01); *G10H 1/0008* (2013.01); *G10H 1/02* (2013.01); *G10H 1/18* (2013.01);
(Continued)

(58) Field of Classification Search
CPC ..... G10H 1/344; G10H 1/0008; G10H 1/02; G10H 1/18; G10H 2220/271
(Continued)

(56) References Cited

U.S. PATENT DOCUMENTS 5,237,123 A * 8/1993 Miller ..... G10G 3/04 84/21
5,512,705 A * 4/1996 Kobayashi ..... G10H 5/007 24/624
(Continued)

FOREIGN PATENT DOCUMENTS

JP H07295568 A 11/1995
JP 2001215965 A 8/2001
JP 2013210451 A 10/2013

OTHER PUBLICATIONS

International Search Report issued in Intl. Appln. No. PCT/JP2016/083005 dated Jan. 17, 2017. English translation provided.
(Continued)

*Primary Examiner* — David S Warren
(74) *Attorney, Agent, or Firm* — Rossi, Kimms & McDowell LLP

(57) ABSTRACT

A keyboard musical instrument is provided in which variations in the detection mechanism is corrected so that an appropriate musical sound control can be performed. Detection sections SW1, SW2, and SW3 detect an object at detection positions pSW1, pSW2, and pSW3. On the basis of a detection timing (rT2) by the detection section SW2, a detected key depression speed (V21), and a detection timing (rT3) by the detection section SW3 in a case where the key is depressed in a derivation mode, after a rST32 value is calculated, a stroke correction value calST32 is derived as correction information J and stored in a memory 57. In the performance mode, the musical sound is controlled on the
(Continued)

basis of the detection timing by the detection sections SW1, SW2, and SW3 and the stroke correction value calST32.

13 Claims, 11 Drawing Sheets

(51) Int. Cl.
*G10H 1/34* (2006.01)
*G10H 1/00* (2006.01)

(52) U.S. Cl.
CPC . *G10H 2220/271* (2013.01); *G10H 2220/285* (2013.01); *G10H 2220/305* (2013.01)

(58) Field of Classification Search
USPC ..... 84/615, 644
See application file for complete search history.

(56) References Cited

U.S. PATENT DOCUMENTS 5,679,914 A * 10/1997 Niitsuma ..... G10C 3/161 84/21
5,691,489 A * 11/1997 Fujiwara ..... G10C 3/161 84/115
5,731,530 A * 3/1998 Fujiwara ..... G10F 1/02 84/115
5,739,450 A * 4/1998 Fujiwara ..... G10G 3/04 84/20
6,051,762 A * 4/2000 Fujiwara ..... G10F 1/02 84/115
6,297,437 B1 * 10/2001 Ura ..... G10H 1/0553 84/18
6,906,695 B1 6/2005 Ishida et al.
7,361,827 B2 * 4/2008 Sasaki ..... G10H 1/346 84/723
7,432,430 B2 * 10/2008 Sasaki ..... G10F 1/02 84/462
7,674,968 B2 * 3/2010 Sasaki ..... G09B 15/08 84/615
7,820,902 B2 * 10/2010 Furukawa ..... G10H 1/0058 84/609
7,902,449 B2 * 3/2011 Furukawa ..... G10H 1/0066 84/462
7,960,629 B2 * 6/2011 Sasaki ..... G10F 1/02 84/20
9,424,825 B2 * 8/2016 Osuga ..... G10H 1/34
9,613,607 B2 * 4/2017 Osuga ..... G10H 1/344
9,613,608 B2 * 4/2017 Osuga ..... G10H 1/344
9,697,816 B2 * 7/2017 Osuga ..... G10H 1/344
2005/0145104 A1 * 7/2005 Sasaki ..... G10H 1/344 84/746
2006/0048624 A1 * 3/2006 Sasaki ..... G10F 1/02 84/13
2006/0054010 A1 * 3/2006 Sasaki ..... G10H 1/346 84/744
2006/0065103 A1 * 3/2006 Sasaki ..... G10F 1/02 84/600
2007/0039452 A1 * 2/2007 Nishida ..... G10H 1/344 84/658
2007/0169608 A1 * 7/2007 Fujiwara ..... G10F 1/02 84/13
2007/0221036 A1 * 9/2007 Fujiwara ..... G10F 1/02 84/21
2007/0295192 A1 * 12/2007 Watanabe ..... G10H 1/344 84/423 R
2009/0084248 A1 * 4/2009 Furukawa ..... G10H 1/0058 84/609
2009/0100979 A1 * 4/2009 Furukawa ..... G10H 1/0066 84/13
2010/0229707 A1 * 9/2010 Sasaki ..... G10F 1/02 84/20
2010/0288102 A1 * 11/2010 Fujiwara ..... G10F 1/02 84/13
2010/0294108 A1 * 11/2010 Shin ..... G10O 3/161 84/236
2011/0132182 A1 * 6/2011 Kikumoto ..... G10H 1/0551 84/744
2014/0069262 A1 * 3/2014 Cheever ..... G10H 1/38 84/613
2015/0090104 A1 * 4/2015 Osuga ..... G10H 1/32 84/744
2015/0220105 A1 * 8/2015 Harimoto ..... G05G 5/03 200/239
2016/0225359 A1 * 8/2016 Osuga ..... G10H 1/344
2016/0225360 A1 * 8/2016 Osuga ..... G10H 1/344
2018/0247628 A1 * 8/2018 Tanoue ..... G10H 1/344

OTHER PUBLICATIONS

Written Opinion issued in Intl. Appln. No. PCT/JP2016/083005 dated Jan. 17, 2017.

* cited by examiner

| KEY |
|---|
| KEY 1 |
| KEY 2 |
| ⋮ |
| KEY 88 |

| SW | STATE | TIME OF CHANGE ON→OFF | TIME OF CHANGE OFF→ON |
|---|---|---|---|
| SW1 | ON | hh:mm:ss:xxxxx | hh:mm:ss:xxx |
| SW2 | ON | hh:mm:ss:xxxxx | hh:mm:ss:xxx |
| ⋮ | ⋮ | ⋮ | ⋮ |
| SWn | OFF | hh:mm:ss:xxxxx | hh:mm:ss:xxx |

FIG. 5A

| KEY | CORRECTION INFORMATION J | rST32 | rST31 | Δd | SILENCING TRIGGER SW | OTHERS |
|---|---|---|---|---|---|---|
| KEY 1 | CORRECTION INFORMATION 1 | p1 | q1 | Δd1 | SW2 | |
| KEY 2 | CORRECTION INFORMATION 2 | p2 | q2 | Δd2 | SW2 | |
| KEY 3 | CORRECTION INFORMATION 3 | p3 | q3 | Δd3 | SW1 | |
| ⋮ | ⋮ | ⋮ | ⋮ | ⋮ | ⋮ | ⋮ |

FIG. 5B

CORRECTION INFORMATION J

| calT1 | calT2 | calT3 | calT31 | calT32 | calST31 | calST32 |
|---|---|---|---|---|---|---|

KEYBOARD MUSICAL INSTRUMENT AND METHOD OF ACQUIRING CORRECTION INFORMATION IN KEYBOARD MUSICAL INSTRUMENT

TECHNICAL FIELD

The present invention relates to a keyboard musical instrument having a displacement member that operates by a key depression operation and a method of acquiring correction information in the keyboard musical instrument.

DESCRIPTION OF THE RELATED ART

Conventionally, keyboard musical instruments are available that have a displacement member, such as a hammer or the like, that is driven and is moved directly or indirectly with a key by the key depression operation. In this kind of musical instrument, a keyboard musical instrument is also available in which the operation of a key or a displacement member is detected, and a musical sound is controlled on the basis of the result of the detection. For example, in the musical instrument of Japanese Laid-Open Patent Publication (Kokai) No. 2013-210451, a musical sound is generated from the key depression speed detected by the two switches, and when one switch detects that the hammer reaches a predetermined turning position, a musical sound is generated.

However, since the key and the displacement member such as a hammer usually are turned around different fulcrums, it is difficult to accurately maintain the relative position of the key and the displacement member at the time of manufacturing. In addition, it is also difficult to ensure high relative arrangement accuracy of detection parts such as a key sensor and a hammer sensor that detect the operation of the key and the displacement member. Furthermore, the key and the displacement member can be deformed by long-term use. Thus, the detection result by the sensor can also change. Therefore, in a case where the velocity, sound generation timing, etc. are determined on the basis of the detection result of the operation of the key and the detection result of the operation of the displacement member, they are affected by dimensional accuracy, assembly deviation, and aging of parts and detection parts.

For example, in a case where the value obtained by dividing the distance from the detection of the key sensor to the detection of the hammer sensor by the time difference is calculated as the key depression velocity, the positional accuracy between the key sensor and the hammer sensor is important. If the positional accuracy is lowered, musical sound control with high accuracy cannot be expected.

SUMMARY OF THE INVENTION

It is an object of the present invention to provide a keyboard musical instrument capable of performing proper musical sound control by correcting variations in detection mechanism and a method of acquiring correction information in the keyboard musical instrument.

In order to achieve the above object, according to the present invention, a keyboard musical instrument is provided which includes a key; displacement members (11) that are directly or indirectly driven and moved by the key due to a depression operation of the key, a first detection unit (SW1, SW2) configured to detect at least a position (pSW1, pSW2) and a speed (V21) of the key or a first member out of the displacement members; a second detection unit (SW3) configured to detect at least a position (pSW3) of a second member other than the first member out of the displacement members; a storage unit (47) configured to store correction information (J, calST32); a derivation unit (45) configured to derive the correction information as an amount to be used for correcting a deviation with respect to a designed value of a physical quantity used for musical sound control (Formula 1) on the basis of a detection timing (rT2) of the position by the first detection unit, the speed (V21) detected by the first detection unit, and a detection timing (rT3) of the position by the second detection unit in a case where the key is operated in a derivation mode, and cause the storage unit to store the correction information; and a musical sound control unit (45) configured to control a musical sound on the basis of the detection timing of the position by the first detection unit, the detection timing of the position by the second detection unit, and the correction information stored in the storage unit in a performance mode.

In order to achieve the above object, according to the present invention, a method of acquiring correction information in a keyboard musical instrument is provided, in which the keyboard musical instrument includes a key, displacement members that are directly or indirectly driven and moved by the key due to a depression operation of the key, a first detection unit configured to detect at least a position of the key or a first member out of the displacement members, a second detection unit configured to detect at least a position of a second member other than the first member out of the displacement members, a storage unit configured to store correction information, and a musical sound control unit configured to control a musical sound on the basis of a detection timing of the position by the first detection unit, a detection timing of a position by the second detection unit, and the correction information stored in the storage unit in a performance mode, and the method includes deriving the correction information as an amount to be used for correcting a deviation with respect to a designed value of a physical quantity used for musical sound control on the basis of the detection timing (rT2) of the position by the first detection unit, and a detection timing (rT3) of the position by the second detection unit in a case where the key is operated in a predetermined operation mode (Vplay) in which an operation speed and a speed change are defined in a derivation mode, and causing the storage unit to store the correction information.

In order to achieve the above object, according to the present invention, a method of acquiring correction information in a keyboard musical instrument is provided, in which the keyboard musical instrument includes a key, displacement members that are directly or indirectly driven and moved by the key due to a depression operation of the key, a first detection unit configured to detect at least a position and a speed of the key or a first member out of the displacement members, a second detection unit configured to detect at least a position of a second member other than the first member out of the displacement members, a storage unit configured to store correction information, and a musical sound control unit configured to control a musical sound on the basis of the detection timing of the position by the first detection unit, the detection timing of the position by the second detection unit, and the correction information stored in the storage unit in a performance mode, and the method includes deriving the correction information as an amount to be used for correcting a deviation with respect to a designed value of a physical quantity used for musical sound control on the basis of a detection timing (rT2) of the position by the first detection unit, the speed (V21) detected by the first detection unit, and a detection timing (rT3) of the position by the second detection unit in a case where the key is operated in a derivation mode, and causing the storage unit to store the correction information.

It should be noted that the above-mentioned reference numerals in parentheses are examples.

According to the present invention, variations in the detection mechanism can be corrected so that appropriate musical sound control can be performed.

According to the present invention, highly reliable correction information can be derived, appropriate sound generation control can be performed, and appropriate silencing control can be performed. In addition, according to the present invention, appropriate silencing control can be performed, the determination accuracy of the key velocity can be enhanced, and the reliability of the key depression speed to be detected can be enhanced. Furthermore, according to the present invention, it is possible to prevent the detection result with a large deviation from being used for musical sound control.

Further features of the present invention will become apparent from the following description of exemplary embodiments with reference to the attached drawings.

BRIEF DESCRIPTION OF THE DRAWINGS

FIG. 5A is a conceptual diagram of a database, and FIG. 5B is a conceptual diagram of data constituting correction information.

DESCRIPTION OF THE EMBODIMENT

Hereinafter, embodiments of the present invention will be described with reference to the drawings.

Figure 1:
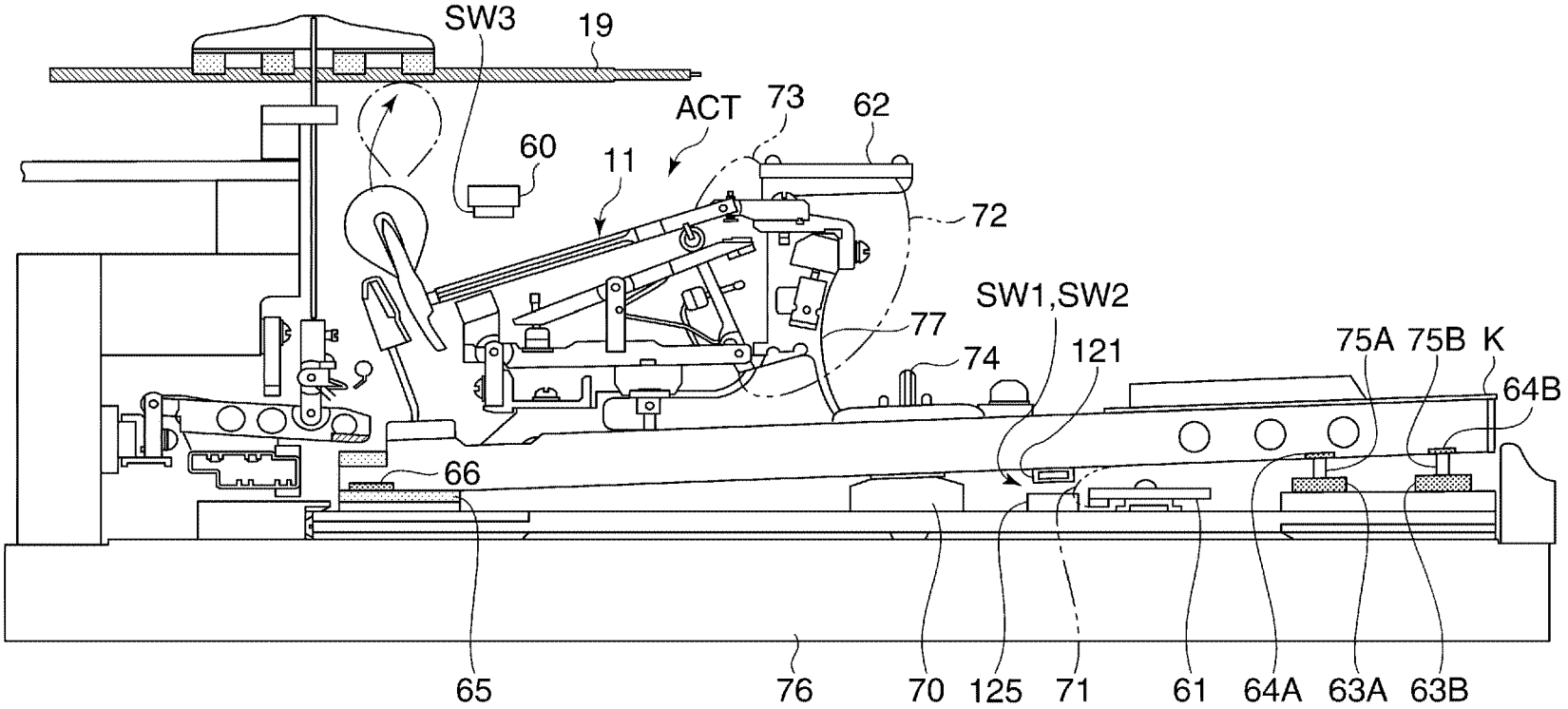
FIG. 1 is a longitudinal sectional view of a keyboard musical instrument according to an embodiment of the present invention.

FIG. 1 is a longitudinal sectional view of a keyboard musical instrument according to an embodiment of the present invention. FIG. 1 mainly shows the configuration of one key K, a corresponding action mechanism ACT and the like.

This keyboard musical instrument is configured as a grand piano type electronic keyboard musical instrument, and a plurality of keys K, which are white keys and black keys, are arranged in parallel. The action mechanism ACT is disposed above the rear end of the key K in correspondence with each key K. Each of the keys K is freely turnably disposed clockwise and counterclockwise in FIG. 1 around a portion in the vicinity of a balance pin 74 in a key fulcrum portion 70 as a fulcrum. The right side of FIG. 1 is the player side and the front side, the left side is the back side. The front portion of the key K is depressed/released.

This keyboard musical instrument can generate sounds by hitting a string 19 by a hammer 11 and also detect the movement and position of the constituent elements in the action mechanism ACT, or the like to generate sound electronically. It should be noted that a silencing stopper 60 is positionally variably attached to a base 76 including a keyboard comb, and the position of the silencing stopper 60 can be switched by an operation of an operation element (not shown). In a case where music is played in the normal sound generation mode in the performance mode, the silencing stopper 60 can be positioned at a position where the hammer 11 does not come into contact with the silencing stopper 60, whereas when music is played in the silencing mode in the performance mode, the silencing stopper 60 is positioned so as to come into contact with the hammer 11, so that the hammer 11 does not come into contact with the string 19.

Front bushing cloths 64A and 64B are disposed at the front lower portion of the key K. In the base 76, front punching cloths 63A and 63B are disposed so as to correspond to the positions of the front bushing cloths 64A and 64B. By a key depression operation, the front bushing cloths 64A and 64B come into contact with the front punching cloths 63A and 63B, so that the turning end position (end position) of the key K is restricted. Movement of the front portion of each key K in the key arrangement direction is restricted by front pins 75A and 75B during the key depression operation.

A conductive unit 66 is disposed at the lower portion of the rear portion of the key K. A back rail cloth 65 is disposed on the base 76 via a back rail under felt in correspondence with the conductive unit 66. When the lower surface of the rear portion of the key K comes into contact with the back rail cloth 65, the conductive unit 66 comes into contact with the back rail cloth 65, and the initial position of the key K in the non key depression state, that is, the turning start position (rest position) is restricted.

An electric circuit board 61 is fixedly arranged with respect to the base 76. In addition, the electric circuit board 62 is fixedly arranged with respect to an action bracket 77. Although there are other electric circuit boards, illustration thereof is omitted.

Figure 2:
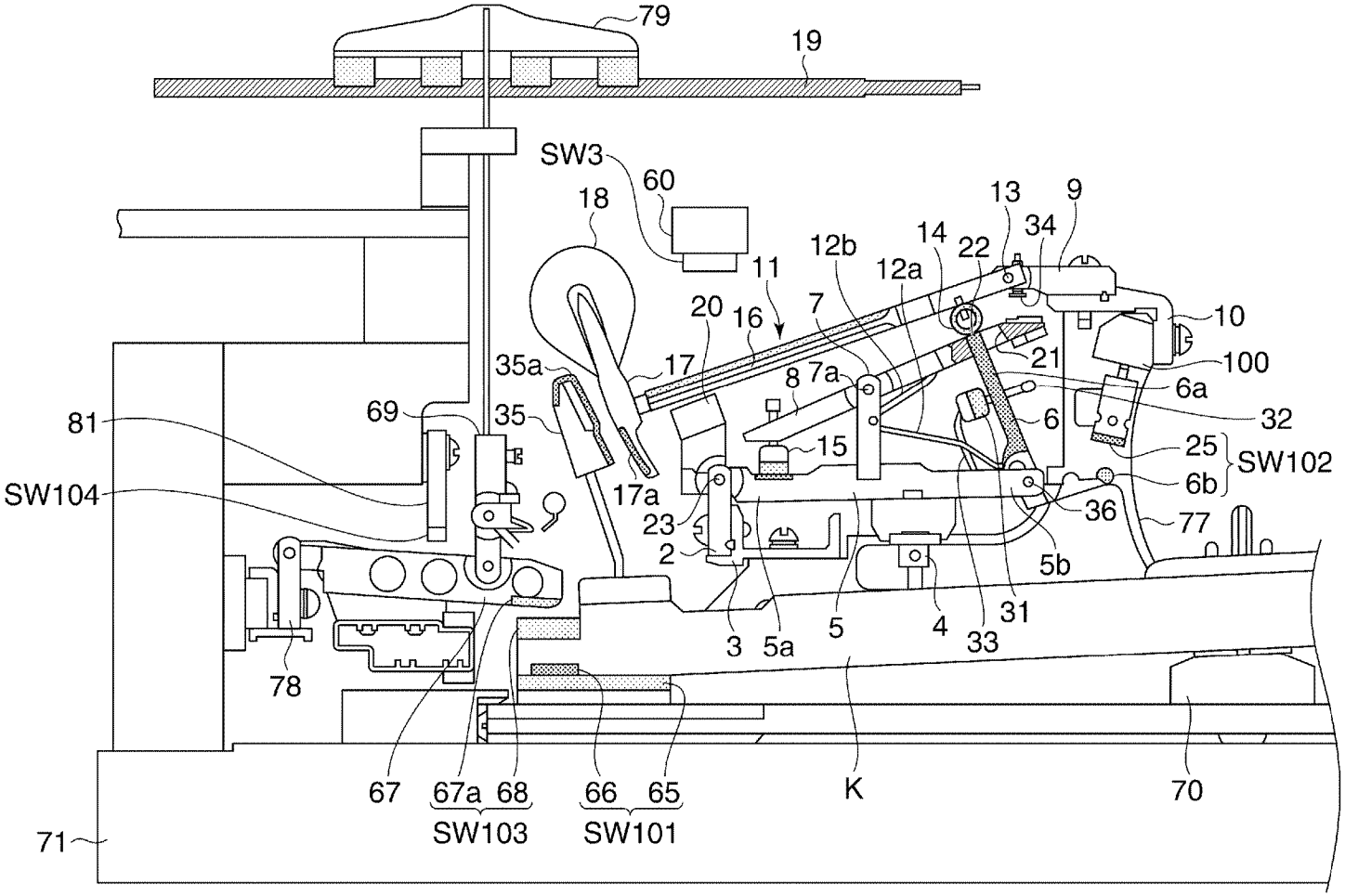
FIG. 2 is a side view of one action mechanism and its peripheral elements.

FIG. 2 is a side view of one action mechanism ACT and its peripheral elements.

A capstan screw 4 is implanted onto the upper surface of the rear end of the key K. A back check 35 is disposed on the upper portion of the rear end of the key K. A damper lever 67 is pivotally supported by a damper lever flange 78 located behind the key K. In addition, the damper lever 67 is pivotally supported by a damper block 69, and a damper 79 is fixed to the damper block 69.

The action mechanism ACT mainly includes a wippen 5, a jack 6, a repetition lever 8, and the like. A turning fulcrum 23 of the rear end 5*a* of the wippen 5 is pivotally supported by a support flange 2 fixed to a support rail 3, and a front end 5*b*, which is a free end, is freely turnable vertically around the turning fulcrum 23. A hammer shank top felt 20 is disposed on the upper surface of the wippen 5 on the turning fulcrum 23 side. A jack stop 33 protrudes from the upper part of the front half portion of the wippen 5.

A repetition lever flange 7 upwardly protrudes from the center of the wippen 5 in the front-rear direction. The repetition lever 8 is rotatably supported clockwise and counterclockwise around the turning fulcrum 7*a* of the upper end of the repetition lever flange 7. The jack 6 has a vertical portion 6*a* extending substantially upward and a jack small portion 6*b* extending forward in a substantially horizontal direction, and has a substantially L-shape in a side view. The jack 6 is disposed on the turning fulcrum 36 of the front end 5*b* of the wippen 5 so as to be rotatable clockwise and counterclockwise in FIG. 2.

The jack stop 33 includes a jack button screw 32 and a jack button 31 disposed at the rear end of the jack button screw 32. In the non key depression state (key released state), the jack 6 comes into contact with the jack button 31, the initial position of the jack 6 is restricted, and the initial position can be adjusted by the jack button screw 32.

A shank flange 9 is fixed to a shank rail 10. A regulating button 25 is disposed so as to be adjustable in height with respect to a regulating rail 100 attached to the shank rail 10. A repetition screw 34 is provided at the lower portion of the shank flange 9. The hammer 11 is disposed above the repetition lever 8. The front end of a hammer shank 16 of the hammer 11 is pivotally vertically supported with respect to the shank flange 9 around the turning center 13. A hammer wood 17 is attached to the rear end of the hammer shank 16, in which the rear end of the hammer shank 16 is free. A hammer felt 18 is attached to the upper end of the hammer wood 17. A hammer roller 14 is disposed in the vicinity of the front end of the hammer shank 16.

In the non key depression state, the repetition lever 8 receives the hammer roller 14 on the upper surface of the front end of the repetition lever 8 from the lower side and restricts the hammer 11 to the initial position. On the other hand, a repetition lever button 15 is disposed on the rear end of the repetition lever 8 so as to be adjustable in height. The button 15 comes into contact with the upper surface of the rear end 5*a* of the wippen 5, whereby the turning of the repetition lever 8 counterclockwise is restricted, and the repetition lever 8 is restricted to the initial position. An elongated hole 21 is formed at the front end portion of the repetition lever 8. The vertical portion 6*a* of the jack 6 is inserted into the elongated hole 21 and a top end surface 22 of the vertical portion 6*a* is substantially flush with the upper surface of the repetition lever 8.

In such a configuration, in the normal key depression forward stroke in which the key K is depressed from the non key depression state, the wippen 5 is pushed up by the rise of the capstan screw 4 and is turned counterclockwise, which is the forward direction, around the turning fulcrum 23. By pushing up the wippen 5, the repetition lever 8 and the jack 6 is turned upward together with the wippen 5. Along with these turning, the repetition lever 8 and the vertical portion 6*a* of the jack 6 push up the hammer 11 via the hammer roller 14 to turn it upward while turning or sliding the hammer roller 14.

On the other hand, as the key K is turned in the forward direction, a damper lever cushion 68 disposed at the upper portion of the rear end of the key K pushes up the front end portion of the damper lever 67. Then, the damper 79 is raised via the damper block 69, and the damper 79 (more exactly, a damper felt provided at the lower portion of the damper 79) is spaced away from the string 19. In the present embodiment, a damper distance d described later is a distance from the damper 79 to the string 19 at the end of key depression.

Next, when the repetition lever 8 comes into engagement contact with the repetition screw 34, whereby the counterclockwise displacement (upper limit position) of the repetition lever 8 is restricted, the top end surface 22 of the vertical portion 6*a* of the jack 6 protrudes through the elongated hole 21 of the repetition lever 8, and the hammer roller 14 is driven by the top end surface 22, so that the hammer 11 is pushed up.

When the wippen 5 is further turned in the forward direction, the jack small portion 6*b* of the jack 6 comes into contact with the lower surface of the regulating button 25 (more exactly, a regulating button punching) during the turning thereof and is inhibited from rising. However, since the wippen 5 itself is still turned, the jack 6 is turned clockwise around the turning fulcrum 36. Therefore, the top end surface 22 of the vertical portion 6*a* of the jack 6 escapes forward from the lower side of the hammer roller 14 forward and moves away from it. As a result, the hammer 11 is disengaged from the jack 6 and strikes the string 19 in a freely turnable state. After the strike, the hammer 11 is turned and returned by its own weight and the repulsive force of the string 19. It should be noted that in the silencing mode, the silencing stopper 60 restricts the turning of the hammer shank 16 of the hammer 11, whereby the hammer shank 16 does not come into contact with the string 19.

When the key depression state is maintained after the completion of the key depression, the hammer wood 17 of the hammer 11 bounced by the string 19 is received by the back check 35 (more exactly, back check cloth 35*a*), and the hammer wood 17 is stopped there. When the key K is released and the back check 35 is disengaged from the hammer 11, the repetition lever 8 is turned counterclockwise by the urging force of a repetition urging unit 12*b*, and the hammer roller 14 is supported by the repetition lever 8.

In addition, after the string striking action, the jack 6 is released from the regulating button 25 as the wippen 5 is turned and returned. The jack 6 is turned counterclockwise by the urging force of the jack urging portion 12*a*, and returned to the initial position. Even if the key K does not completely return to the non-key depression position, the top end surface 22 of the vertical portion 6*a* of the jack 6 quickly returns to the lower side position of the hammer roller 14 so that the next string striking action by the second depression of the key can be performed. That is, fast four-handed performance is possible.

In the present embodiment, a member that is directly or indirectly driven by the key K to be displaced (moves) in the forward direction due to the key depression operation, and that moves in the backward direction by releasing the key K is referred to as the "displacement member".

In addition, in this keyboard musical instrument, a constituent element, of which the engagement state with respect to an object to be engaged can be changed in the stroke of the key depression/release operation, will be referred to as the "constituent member". The constituent member includes not only a single component but also component members configured as an integrated unit or component members movable as an integrated unit. For example, in addition to the key K and the hammer 11, and elements intervened in the system ranging from the key K to the hammer 11 and elements for restricting the turning start position and the turning stop position of the key K and the hammer 11 correspond to the constituent members. More specifically, in addition to the above-mentioned items, the elements designated by reference numerals 5, 6, 7, 8, 9, 11, 15, 19, 20, 25, 31, 34, 35, 60, 63, 65, 79, etc. can correspond to the constituent members. It should be noted that the elements 64, 66 and 68 may be regarded as portions of the key K. The elements 14, 16, 17, and 18 may be regarded as portions of the hammer 11. The movable constituent member other than the key K can correspond to the "displacement member". It should be noted that the constituent members are not limited to these items taken as examples.

The keyboard musical instrument includes a plurality of detection sections SW (detection sections SW1, SW2, SW3, SW101 to 104) for the key K. The detection sections SW detect the operations of the key K and the displacement members or the engagement states of the constituent members to be engageable with each other. The detection section SW3 is disposed on the lower surface of the silencing stopper 60. Hence, in the silencing mode, the hammer 11 comes into contact with the detection section SW3 and indirectly comes contact with the silencing stopper 60 via the detection section SW3.

In the present embodiment, the hammer 11 is taken as an example of the displacement member, and musical sound information including key velocity is generated on the basis of the detection results by the detection sections SW1, SW2, and SW3, and the sound generation/silencing timing is determined.

Figure 3A:
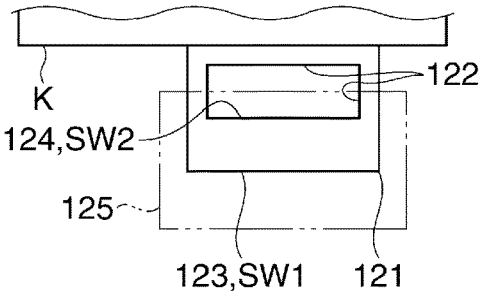
FIG. 3A is a side view showing a configuration of a detection section.
Figure 3B:
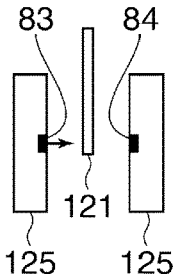
FIG. 3B is a front view showing a configuration of a detection section.

FIGS. 3A and 3B are a side view and a front view showing the structures of the detection sections SW1 and SW2. The detection sections SW1 and SW2 are photo-interrupter type optical sensors and include a shutter member 121 attached to the lower surface of the key K and an interrupter unit 125 fixed to the base 76. The interrupter unit 125 has a pair of a light emitting unit 83 and a light receiving unit 84. The shutter member 121 is integrally formed of resin or the like, and is formed of a material having a light shielding property or has a light shielding material applied to its surface. The shutter member 121 includes a window 122. The lower edge of the shutter member 121 is a first boundary 123 and the lower edge of the window 122 is a second boundary 124. When the first boundary 123 and the second boundary 124 pass through an optical path from the light emitting unit 83 to the light receiving unit 84 in the forward direction, the detection sections SW1 and SW2 sequentially turn ON. When the first boundary 123 and the second boundary 124 pass through the optical path in the backward direction, the detection sections SW2 and SW1 are sequentially turned off.

Figure 3C:
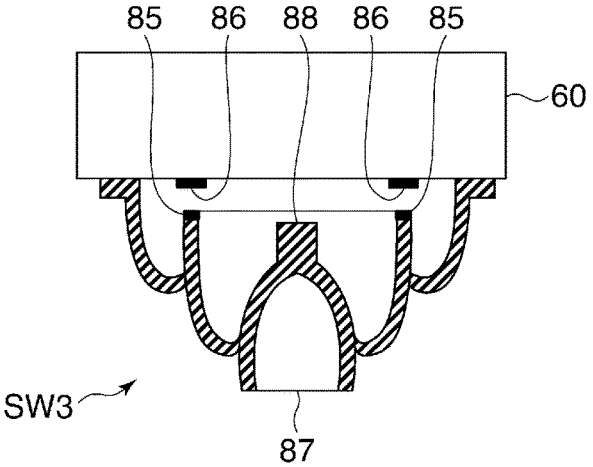
FIG. 3C is a sectional view showing a configuration of a detection section.

FIG. 3C is a sectional view showing a configuration of a detection section SW3. The detection section SW3 is configured as a make-switch having a small pressing stroke and has a driven unit 87 on the lower side thereof, in which the driven unit 87 expands downward in a dome shape. When the driven unit 87 is driven by the hammer 11, a movable contact 85 comes into contact with a fixed contact 86 disposed on the lower surface of the silencing stopper 60, whereby the detection section SW3 electrically turns ON. Inside the dome, a stopper unit 88 located farther away from the lower surface of the silencing stopper 60 than the movable contacts 85 in the non key depression state is disposed.

The start point of the whole turning stroke serving as the operation range of the hammer 11 in the silencing mode is restricted when the hammer 11 comes into contact with the repetition lever 8. On the other hand, the end point of the whole stroke is restricted when the stopper unit 88 comes into contact with the lower surface of the silencing stopper 60. The detection section SW3 maintains its ON state only when the hammer 11 is located at a position (upper position) deeper than a predetermined position.

Figure 3D:
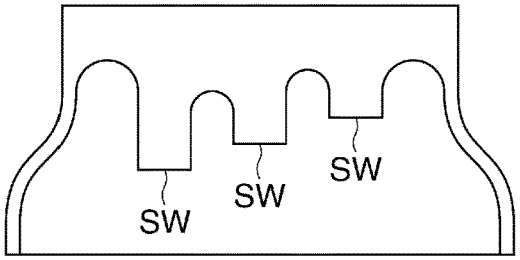
FIG. 3D is a sectional view showing a configuration of a detection section.

It should be noted that the detection section for detecting the operation of the key K is not limited to the one illustrated in FIGS. 3A and 3B. It may be constituted by a resiliently swollen electric contact type switch similar to the switch shown in FIG. 3C. In this case, the detection section for detecting the operation of the key K may detect the position at one location. For example, as shown in FIG. 3D, the detection sections may detect at a plurality of different stroke positions, for example, at three or more locations.

The detection sections SW101 to SW104 may merely be configured so as to be able to detect the operation of the key K and the displacement member, and it is possible to employ a configuration that matches the arrangement location. For example, the detection section SW104 (FIG. 2) has the same configuration as the detection section SW3. The detection section SW104 is disposed at the lower portion of a stop rail 81.

For detection sections SW101, SW102, and SW103, a switch having an ordinary switch which turns ON by contact or by change in pressure may be employed. In this embodiment, a configuration in which the engagement state of the constituent members is detected depending on the state of the electrical conduction between the constituent members is employed as an example. More specifically, each of the engaged sections of the constituent members, in which the engaged sections are engaged with each other, is configured so as to have conductivity, and a CPU 45 (FIG. 4A) detects the engagement state of the constituent members by utilizing the fact that conduction occurs when the constituent members come into contact with each other and that non-conduction occurs when they are spaced away from each other.

In order to easily realize the above-mentioned conduction configuration, for example, conductive materials are disposed in the region of the engaged sections, which are engaged with each other. As a conductive material, graphite, conductive rubber, conductive nonwoven fabric, copper plate, conductive coating (conductive grease), or the like is disposed on at least the surface of the engaged region or the engaged surface. In a case where cloth, or the like is used, the entire cloth may be formed of a conductive material. Alternatively, the whole or at least the respective engaged sections of the movable constituent members and the corresponding constituent members may be made of a conductor or a conductive material. For example, the whole or the engaged sections of the constituent members are formed of resin. The configurations having conductivity may be different between the movable constituent members and the corresponding constituent members.

For the detection section SW103, both (the damper lever cushion 68 of) the key K and (the contact unit 67*a* of) the damper lever 67 are made of conductors. For the detection section SW102, both the regulating button 25 and (the jack small portion 6*b* of) the jack 6 are made of conductors. For the detection section SW101, both the back rail cloth 65 and (the conductive unit 66 of) the key K are made of conductors. A configuration similar to that described above is applicable to constituent members other than the above constituent members. It should be noted that both the jack 6 and the hammer roller 14 may be made of conductors.

The conductive unit having conductivity are electrically connected to the electric circuit board. In FIG. 2, the electric circuit board is not shown. As shown in FIG. 1, for example, the conductive unit of the jack 6 is connected to the electric circuit board 62 with a wire 72 such as a flexible lead, and the hammer roller 14 is also connected to the electric circuit board 62 with a wire 73. In addition, the front bushing cloths 64A and 64B are connected to the electric circuit board 61 with a wire 71, and the front punching cloths 63A and 63B are also connected to the electric circuit board 61 with a wire (not shown). The conductive units of other engaged sections are also appropriately connected to the electric circuit boards 61 and 62 or an electric circuit board (not shown) with a wire.

Each detection section SW electrically turns ON when it becomes conductive, and electrically turns OFF when it becomes non-conductive. However, in the present embodiment, in a case where it is detected that the key K and the displacement member are located at a position in the forward direction from a certain position in the key depression forward stroke regardless of the electrical ON/OFF, it is defined that each detection section SW switches from OFF to ON.

On the other hand, as in the detection section SW101, the back rail cloth 65 is spaced away from the conductive unit 66 of the key K when the key is depressed even just a little bit, and the detection section SW101 turns OFF. In this type of detection section that turns ON electrically in the non key depression state, the key depression operation is detected when the detection section electrically turns OFF. Hence, when the detection section electrically turns OFF, the detection result is regarded as ON. It should be noted that a detection section SW other than the illustrated ones may be provided.

Figure 4A:
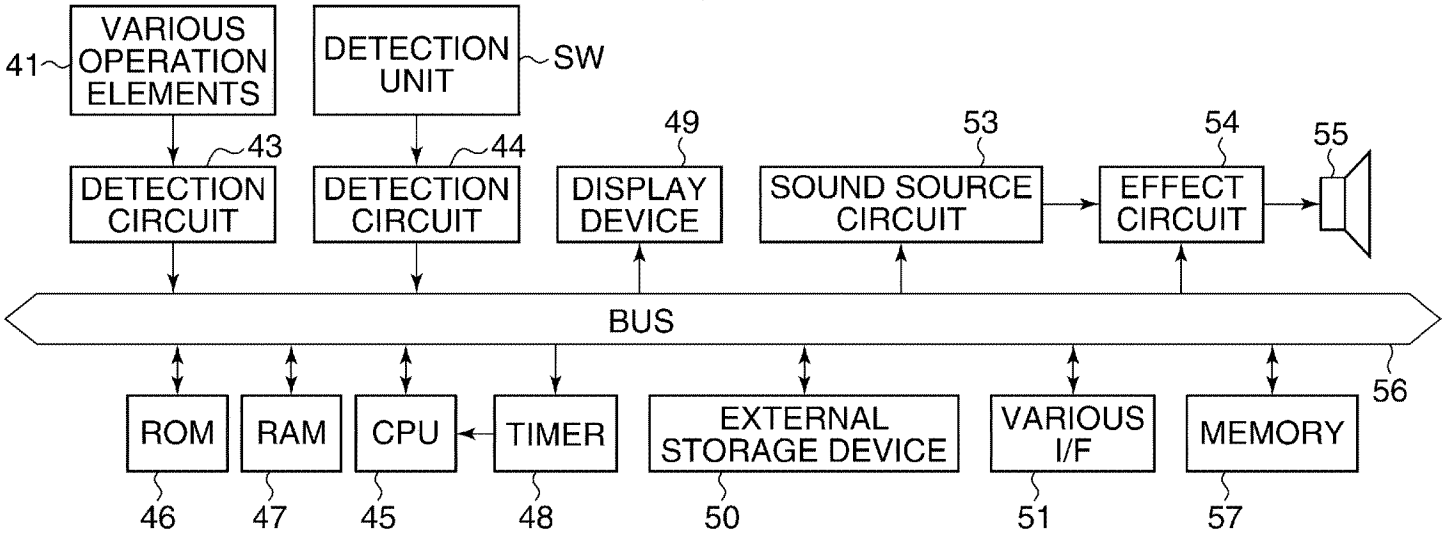
FIG. 4A is a block diagram showing the overall configuration of the keyboard musical instrument.

FIG. 4A is a block diagram showing the whole configuration of the keyboard musical instrument. The keyboard musical instrument has a detection circuit 43, a detection circuit 44, a ROM 46, a RAM 47, a timer 48, a display device 49, an external storage device 50, various interfaces (I/F) 51, a memory 57, a sound source circuit 53, and an effect circuit 54, all of which are connected to the CPU 45 via a bus 56.

Furthermore, the detection section SW is connected to the detection circuit 44. Various operation elements 41 include a performing operation element such as the key K. The timer 48 is connected to the CPU 45, and a sound system 55 is connected to the sound source circuit 53 via the effect circuit 54.

The detection circuit 43 detects the operation states of the various operation elements 41. The detection circuit 44 detects the conduction states of the detection sections SW and supplies the detection results to the CPU 45. The CPU 45 controls the whole keyboard musical instrument. The ROM 46 stores control programs to be executed by the CPU 45, various table data, etc. The RAM 47 temporarily stores various input information such as performance data and text data, various flags, buffer data, operation results, etc. The timer 48 counts an interruption time in a timer interruption process and various times. The various interfaces (I/F) 51 include a MIDI interface and a communication interface. The sound source circuit 53 converts performance data having been input from the various operation elements 41, preset performance data, etc. into musical sound signals. The effect circuit 54 gives various effects to musical sound signals to be input from the sound source circuit 53, and the sound system 55 including a DAC (digital-to-analog converter), an amplifier, speakers, etc. converts musical sound signals and the like to be input from the effect circuit 54 into sound. The memory 57 is a nonvolatile readable/writable storage device.

Figure 4B:
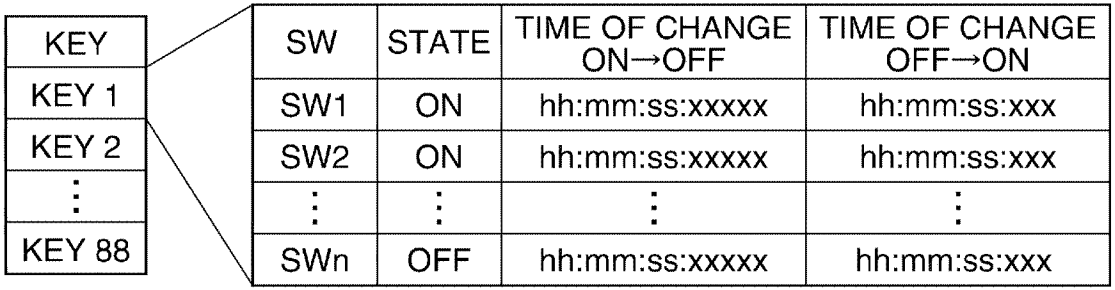
FIG. 4B is a conceptual diagram showing information on a detection result in the detection section.

FIG. 4B is a conceptual diagram indicating the information of the detection results in the detection section SW, the information being stored in a register. The information of the detection results in the detection sections SW is information indicating ON/OFF conduction states and change times when ON/OFF switching has occurred, and the information for all the detection sections SW is stored in the register of the RAM 47 for each key K. It should be noted that the information on the detection sections SW which does not use the detection information is not necessary to be stored.

FIG. 5A is a conceptual diagram of a database stored in a correction information storage process. The correction information storage process is a process for implementing a method of acquiring correction information. In this process, as will be described later with reference to FIG. 8, correction information J and various parameters are derived from the detection result by the detection section SW when the key K is operated in the correction information derivation mode. Information such as the derived correction information J and the like is databased and stored in the memory 57 for each key K. FIG. 5B is a conceptual diagram of data constituting correction information J. In the present embodiment, an example is shown in which these pieces of information are acquired from the detection results by the three detection sections SW1, SW2, and SW3.

Figure 6A:
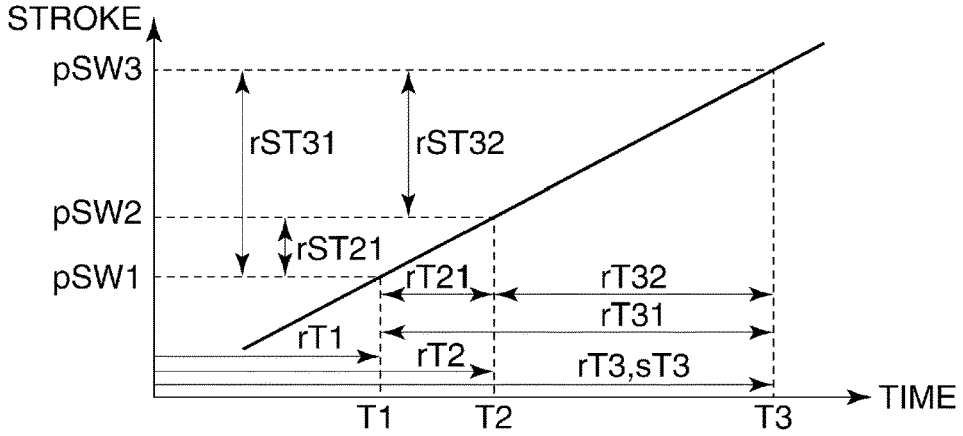
FIG. 6A to FIG. 6C are diagrams showing the relations between time and key stroke in a key depression/release stroke.
Figure 6B:
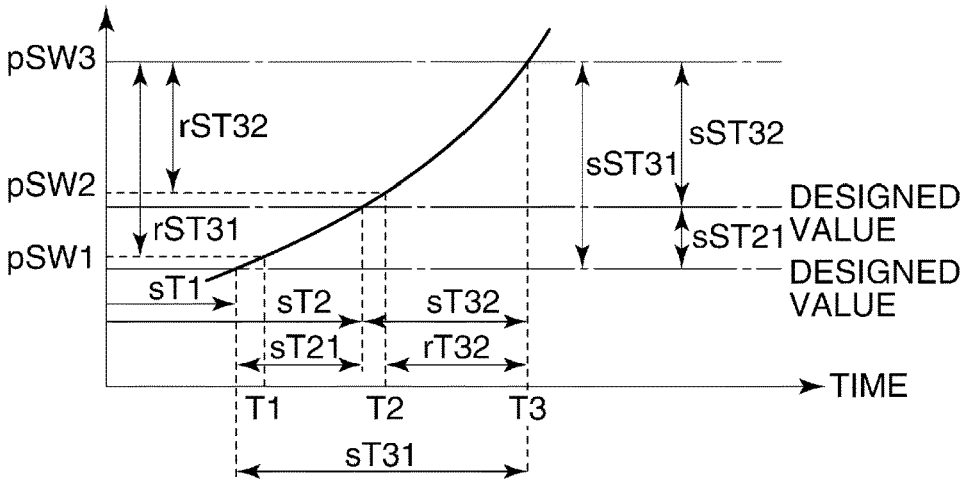
Figure 6C:
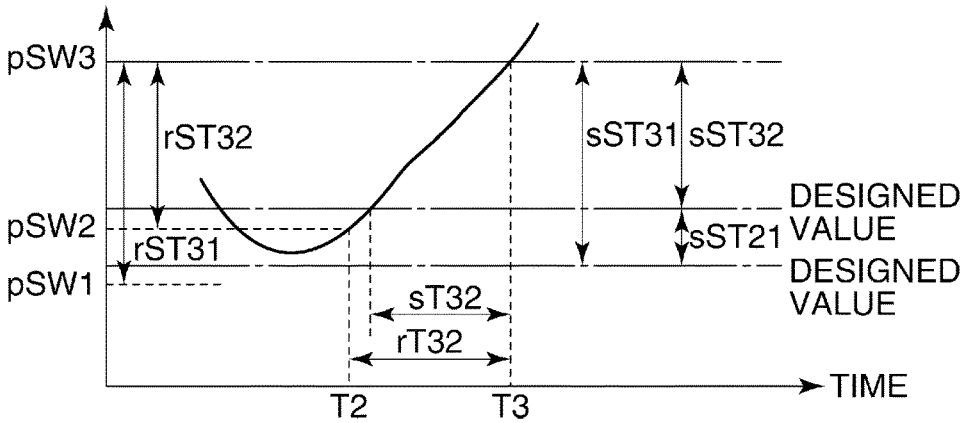

FIG. 6A to FIG. 6C are diagrams showing the relations between time and key stroke in a key depression/release stroke. The horizontal axis shows the elapsed time from the start of the key depression, and the vertical axis shows the key stroke. On the vertical axis, the detection positions of the objects by the detection sections SW1, SW2, and SW3 are written as "pSW1 and pSW2, and pSW3". In particular, FIG. 6A shows a change in operation of the key K in a constant speed key depression in the derivation mode, and FIGS. 6B and 6C show changes in operation of the key K in performance in the silencing mode.

First, explanation will be made with reference to FIG. 6A. In the key depression forward stroke, the positions of the key K are detected by the detection sections SW1 and SW2 sequentially, and thereafter the position of the hammer 11 is detected by the detection section SW3. "pSW1 and pSW2" on the vertical axis indicate the stroke positions of the key K. "pSW3" on the vertical axis indicate the stroke position of the key K which is assumed at the time when the hammer 11 is detected by the detection section SW3 in the constant speed key depression. It should be noted that the constant speed key depression described here is a speed at which the hammer 11 is turned with inertia to depress the detection section SW3 after the jack 6 has come out (escaped) from the hammer roller 14 accompanied by the turning of the key K, and the key depression speed is Vplay.

Hereinafter, from the start of the key depression, the time until the key K and the hammer 11 are detected by the detection sections SW1, SW2, and SW3 is taken as T1, T2, and T3. The time difference from the time T1 to the time T2 is described as a time difference T21. Similarly, the time difference from the time T1 to the time T3, and the time difference from the time T2 to the time T3 are described as the time differences T31 and T32, respectively. The stroke (the physical quantity corresponding to the movement stroke of the key K moving between the detection timings by the detection sections SW1 and SW2) between the detection positions of the detection sections SW1 and SW2 is described a stroke ST21. Similarly, the stroke between the detection positions of the detection sections SW1 and SW3, and the stroke between the detection positions of the detection sections SW2 and SW3 are described as strokes ST31 and ST32, respectively.

Here, these physical quantities differ between the measured value and the designed value (known). Hereinafter, "r" is added to the head of the measured value or the amount derived from the measured value, and "s" is added to the head of the amount of the designed value to distinguish between the measured value and the designed value. For example, as shown in FIG. 6A or FIG. 6B, measured values corresponding to the times T1, T2, and T3 are described as times rT1, rT2, and rT3. The measured values corresponding to the time differences T31, T32, and T21 are described as time differences rT31, rT32, and rT21. The physical quantities corresponding to the strokes ST31, ST32, and ST21, and derived on the basis of the measured values are described the strokes rST31, rST32, and rST21. It should be noted that since the detection section SW3 is used as a sound generation trigger and since the detection position by the detection section SW3 as the absolute position has high reliability, the time rT3 and the time sT3 coincide with each other in a case where the constant speed key depression is performed.

On the other hand, since the key K is deformed due to aging, the relative positional relations between the key K and the detection section SW1, SW2 can be changed. In addition, it is difficult to ensure high accuracy with respect to the relative positional relation between the key K and the hammer 11. Due to these circumstances, the reliability of the absolute value of the detection results by the detection sections SW1 and SW2 is not so high, and the reliability of the relative values of the detection results by the detection section SW1 and the detection section SW2 with respect to the detection section SW3 is not so high. Therefore, as illustrated in FIG. 6B and FIG. 6C, a deviation may occur between the measured stroke rST (for example, rST31 and rST32) and the design stroke sST (for example, sST31 and sST32). However, since the shutter member 121 is integrally formed, the reliability of the relative positional relation (distance) between the first boundary 123 and the second boundary 124 is high. Therefore, it can be assumed that the stroke rST21 and the stroke sST21 coincide with each other. In addition, it can be assumed that the time difference rT21 coincides with the time difference sT21 in a case of performing the constant speed key depression.

In the database shown in FIG. 5A, in addition to the correction information J, various parameters include the strokes rST32 and rST31, a deviation Δd, designation of a silencing trigger SW, and others. The deviation Δd is a value indicating a deviation (a deviation from the damper position) between the OFF detection position by the detection section SW2 and the damper distance d in a case where the silencing trigger SW is regarded as the detection section SW2. The starting point of the damper distance d in the key release direction is a position corresponding to the key depression end, for example, the detection position by the detection section SW3. The starting point may be any position as long as the distance from the detection position is known. The deviation Δd will be described in detail with reference to FIGS. 7A to 7C. The silencing trigger SW is information for designating which of the detection sections SW1 and SW2 should be used as a trigger for starting silencing. It should be noted that hereinafter, a method of using the detection section SW3 will be described first, and a method of using the silencing trigger SW will be described later as a modification (FIGS. 7B and 7C).

These various parameters (the strokes rST32 and rST31, the deviation Δd, the designation of the silencing trigger SW and others) can be derived from the correction information J at the stage of musical sound control by calculation or the like. In the present embodiment, these are also stored for speeding up the process. It is enough to store the correction information J at a minimum, and storage of various parameters is not indispensable.

The correction information J is an amount to be used for correcting a deviation with respect to a designed value of a physical quantity used for musical sound control. As shown in FIG. 5B, the correction information J includes time correction values calT1, calT2 and calT3, time difference correction values calT31 and calT32, and stroke correction values calST31 and calST32. In the present embodiment, the stroke correction value calST32 is used, and since it is not necessary to use values other than the calST32, it is not indispensable to store the values other than the calST32. In a case where the stroke correction value calST32 is not stored as the correction information J, the time correction values calT2 and calT3 may be stored, or the time difference correction value calT32 may be stored as a minimum.

Although details will be described later with reference to FIG. 8, the outline of the derivation of the stroke correction value calST32 by the CPU 45 will be described. In the derivation mode, the CPU 45 calculates the times rT3 and rT2 from the detection results by the detection sections SW3 and SW2 in a case where the key is depressed at the key depression speed Vplay with a constant speed. Here, it is assumed that the derivation mode at the key depression speed Vplay is performed before the shipment of the keyboard musical instrument. However, the mode may be performed by a service engineer, or the like after shipment. It should be noted that the configuration of the device for operating at a constant speed is assumed to be capable of depressing the key at a controlled speed by a servo mechanism or the like, but any other configuration may be employed.

The CPU 45 calculates a time difference rT32 from rT32=rT3−rT2 using the time rT3 and rT2. Further, the CPU 45 calculates the stroke rST32 from rST32=rT32×Vplay using the time difference rT32. Using the stroke rST32, a stroke correction value calST32 is calculated from the following Formula 1 as correction information J.

$$calST32 = rST32 - sST32 \quad \text{[Formula 1]}$$

In addition to this, the deviation Δd is calculated from Δd=d−rST32 using the stroke rST32. Then, these values are stored in the memory 57.

It should be noted that in a case where designation of the silencing trigger SW is requested, the stroke rST31 is also calculated, a value closer to the damper distance d out of the rST31 value and the rST32 value is determined, and the detection section SW corresponding to the determined value (SW1 corresponding to rST31, and SW2 corresponding to rST32) is designated as the silencing trigger SW (described later with reference to FIGS. 7B and 7C).

It should be noted that when the user controls the musical sound control (FIG. 9), the stroke rST32 can be used. However in a case where the stroke rST32 is not stored, the stroke rST32 is calculated from the following Formula 2 obtained by modifying the Formula 1 using the calST32 value, and this stroke rST32 may be used for control.

$$rST32 = sST32 + calST32 \quad \text{[Formula 2]}$$

Although parameters and correction information J obtained from other SWs are not shown, they can be calculated in the same way and may be stored in the memory 57 as necessary.

In the musical sound control, the key depression speed (velocity) in the key depression stroke by performance is calculated from the detection results by the detection sections SW2 and SW3. The key depression speed V32 can be calculated from the time difference between the detection timing by the detection section SW2 and the detection timing by the detection section SW3, and the stroke difference between these detection sections SW. Conventionally, it is usual to calculate the key depression speed V32 from V32=sST32/rT32 on the basis of the designed value stroke sST32 and the time difference rT32 at the performance operation. In contrast, in the present embodiment, using the stroke rST32 which is the actual value, the key depression speed V32 is calculated from the following Formula 3. As a result, it is possible to reduce the influence of a manufacturing deviation and a dimensional deviation.

$$V32=rST32/rT32 \quad \text{[Formula 3]}$$

It should be noted that as a key depression velocity, the key depression speed V31 obtained from the detection results by the detection sections SW1 and SW3 may be used. In the present embodiment, the key depression speed V32 obtained from the detection results by the detection sections SW2 and SW3 will be used. This is because, as illustrated in FIG. 6C, the key K may be depressed again before returning to the position of the detection section SW1, and the ON detection by the detection section SW1 may not be performed in some cases. It should be noted that the use of the key depression speed V21 obtained from the detection results by the detection sections SW1 and SW2 may be acceptable. However, the distance between the detection sections SW1 and SW2 is too small, and the detection sections SW1 and SW2 are far away from the position of the detection section SW3 where a sound generation timing is determined. The key depression speed may change halfway through the key depression and it is preferable to monitor the speed until immediately before the sound generation timing and it is appropriate to use the detection result by the detection section SW3 to calculate the key depression speed V where the sound generation timing is determined by the detection result.

In a case where the time correction values calT2 and calT3 are stored as the correction information J, the calT2 value is calculated from calT2=rT2−sT2 and the calT3 value is calculated from calT3=rT3−sT3. At the stage of the musical sound control in this case, rT2 value is calculated from rT2=calT2+sT2, and rT3 value is calculated from rT3=calT3+sT3. Then, rT32 value is calculated from rT32=rT3−rT2, and stroke rST32 is calculated from rST32=rT32×Vplay. A manner of using the calculated rST32 value is the same as described above.

In addition, in a case where the time difference correction value calT32 is stored as the correction information J, the calT32 value is calculated from calT32=rT32−sT32. At the stage of the musical sound control in this case, rT32 value is calculated from rT32=sT32+calT32, and the stroke rST32 is calculated from rST32=rT32×Vplay. A manner of using the calculated rST32 value is the same as described above.

Figure 7A:
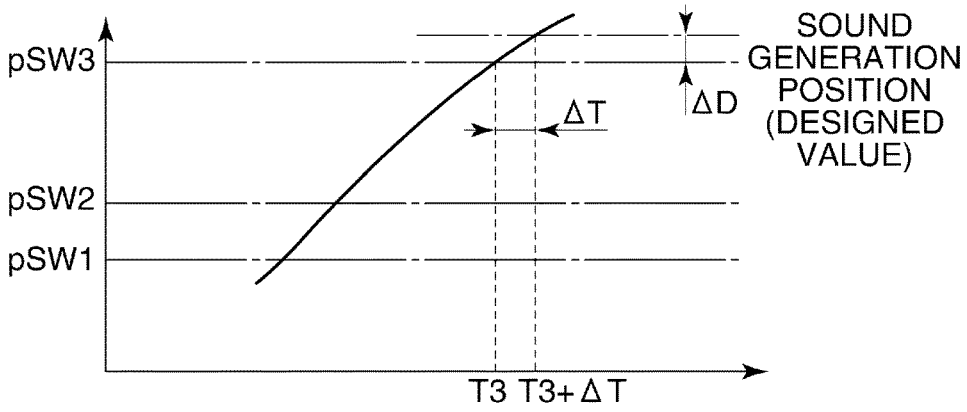
FIG. 7A to FIG. 7C are diagrams showing the relations between time and key stroke in the key depression/release stroke.
Figure 7B:
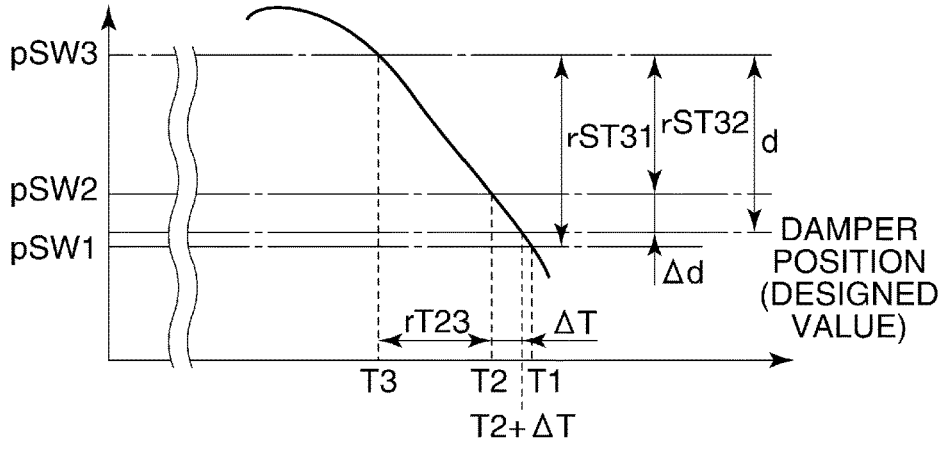
Figure 7C:
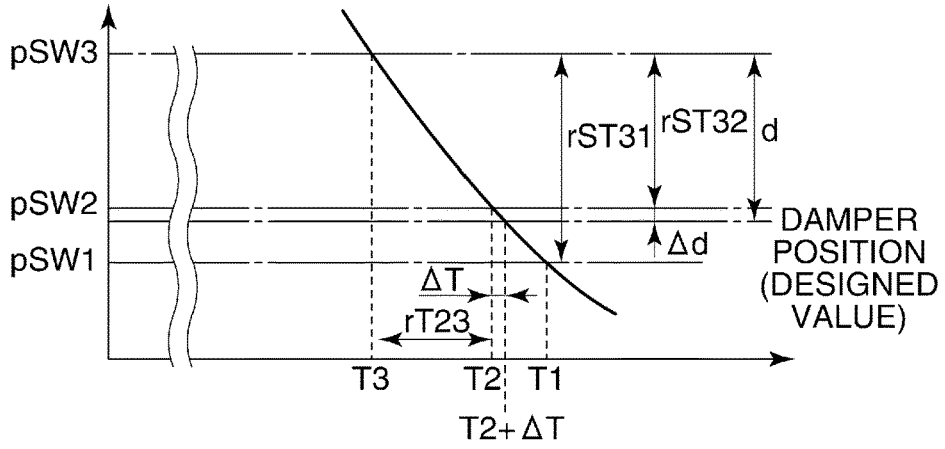

FIG. 7A to FIG. 7C are diagrams showing the relations between time and key stroke in a key depression/release stroke. The meaning of the horizontal axis and the vertical axis is the same as those in FIGS. 6A to 6C. In particular, FIG. 7A shows how the sound generation timing is determined in the key depression stroke during performance. In particular, FIGS. 7B and 7C show how the silencing timing is determined in the key release stroke during performance.

First, a manner of determining sound generation timing will be described with reference to FIG. 7A. In the key depression stroke by performance, the detection section SW3 is disposed at a position at which the detection section SW3 turns ON slightly earlier than the timing at which the hammer 11 will strike if there is no silencing stopper 60. The CPU 45 performs control to start a sound generation at a timing obtained by correcting the detection timing of ON by the detection section SW3 to a delayed side on the basis of the correction information J. Specifically, the sound generation is started at the timing of T3+ΔT, which is later by a delay time ΔT than the time T3 which is the ON timing of the detection section SW3. In the key depression stroke, the delay time ΔT is a time corresponding to a position where the key K is displaced in the key depression end direction by the delay amount ΔD than the stroke position exhibited when the detection section SW3 is ON. In a case where the key depression speed V32 calculated on the basis of the detection time interval of the detection sections SW2, SW3 is employed as the key depression velocity during depression, the delay time ΔT is calculated from ΔT=ΔD/V32. The key depression speed V32 is calculated from the above-mentioned Formula 3. In this respect, the stroke rST32, which is used in the Formula 3, can be calculated from the above-mentioned Formula 2 using the stroke correction value calST32. By using the stroke correction value calST32 to determine the sound generation timing, the detection timing of ON by the detection section SW3 is considered to be corrected on the basis of the correction information J. It should be noted that the rST32 value stored as a parameter may be used.

Next, with reference to FIGS. 7B and 7C, there will be described a manner of determining the silencing timing in a case where the silencing trigger SW is the detection section SW2. In the present embodiment, in a key release stroke by performance, the CPU 45 performs control to start silencing at a timing obtained by correcting the timing of switching from ON to OFF by the detection section SW2 to a delayed side on the basis of the correction information J. Specifically, the silencing is started at the timing of T2+ΔT, which is later by the delay time ΔT than the time T2 which is the OFF timing of the detection section SW2.

In a case where a key release speed V23 calculated on the basis of the detection time interval of the detection sections SW3, SW2 is employed as a key release velocity, the delay time ΔT is calculated from ΔT=Δd/V23. The time difference rT23 is calculated from rT23=rT2−rT3. Then, the key release speed V23 is calculated from the following Formula 4.

$$V23=rST32/rT23 \quad \text{[Formula 4]}$$

In this respect, the stroke rST32, which is used in the Formula 4, can be calculated from the above-mentioned Formula 2 using the stroke correction value calST32. By using the stroke correction value calST32 to determine the silencing timing, the switching timing from ON to OFF by the detection section SW2 is determined to be corrected on the basis of the correction information J. It should be noted that the rST32 value stored as a parameter may be used.

It should be noted that as a variation, there will be described a manner of determining the silencing timing in a case where the designated information of the silencing trigger SW is used. First, as described above, the CPU 45 determines a trigger for starting the silencing on the basis of the rST31 value or the rST32 value, whichever is closer to the damper distance d. In the example of FIG. 7B, since the rST31 value is closer to the damper distance d, the detection section SW to be used as a trigger for starting silencing is determined to be the detection section SW1. In the example of FIG. 7C, since the rST32 value is closer to the damper distance d, the detection section SW to be used as a trigger for starting silencing is determined to be the detection section SW2.

Then, the timing at which the detection section SW to be used as a trigger is switched from ON to OFF is regarded as the silencing timing. Alternatively, the timing when a predetermined time as a fixed value has elapsed from the timing at which the detection section SW to be used as a trigger is switched from ON to OFF may be used as the silencing timing.

Figure 8:
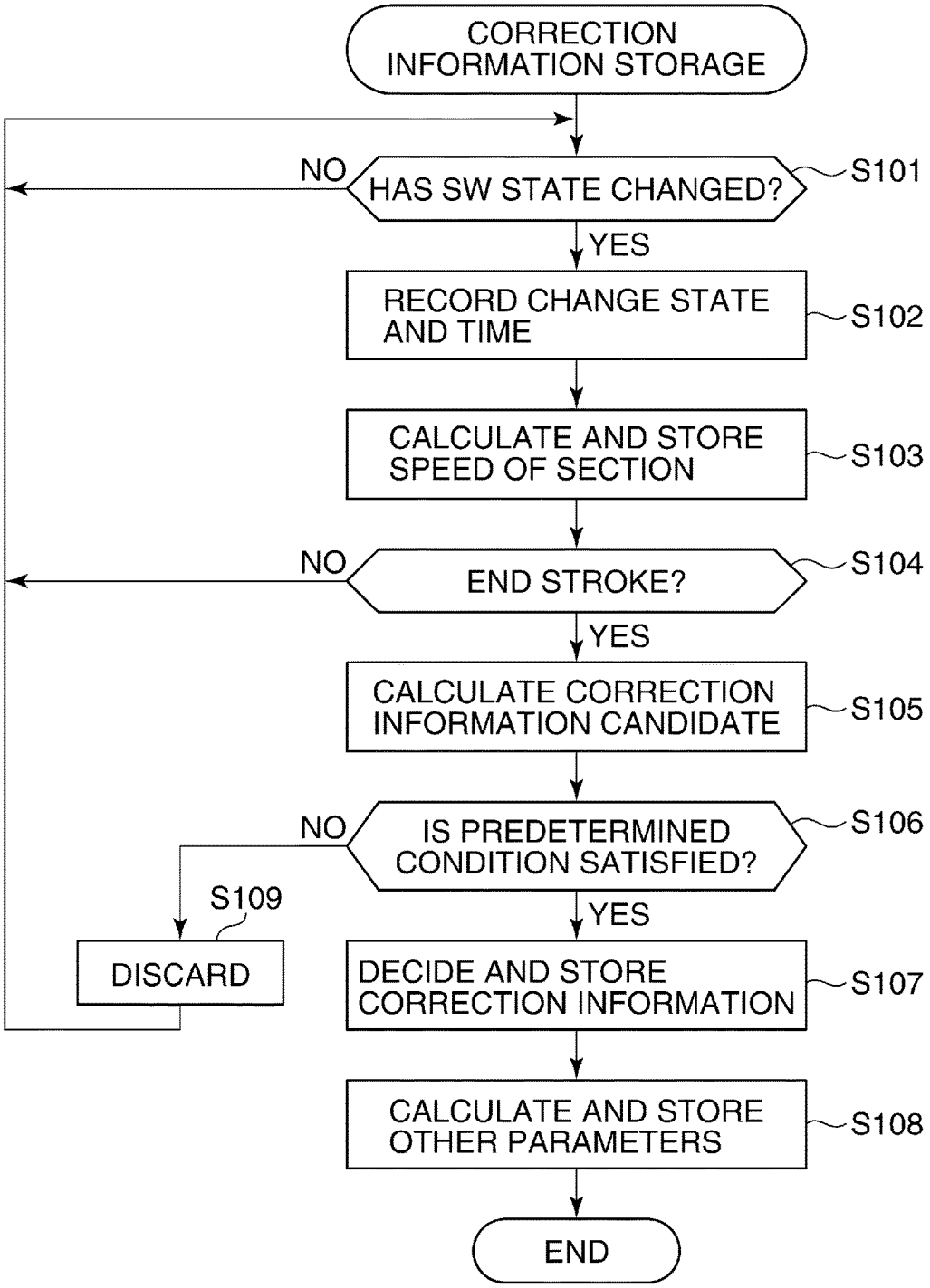
FIG. 8 is a flowchart showing a correction information storage process in a derivation mode.

FIG. 8 is a flowchart showing a correction information storage process in a derivation mode. This process is executed for each key K. In this respect, a process using three detection sections SW1, SW2, and SW3 is exemplified. Any or all of the detection sections SW101 to SW104 may be additionally used, and the number of detection sections SW to be used is not limited. In this process, in a case where there is a mechanism for operating the key K at a constant speed, a key is depressed at the key depression speed Vplay with a constant speed. In a case where such a mechanism is not provided, the operator (user or service person) depresses the key at the key depression speed Vplay as a target.

First, when a key depression is started, the CPU 45 monitors a change in state in each detection section SW (SW1 to SW3) (step S101), and if there occurs the change in state, the CPU 45 causes the register of the RAM 47 to store the detection result (changing state and time of change) by the detection section SW (step S102), which enables information on the detection result to be held (FIG. 4B). It should be noted that, for this detection result, an average value in multiple key depressions may be held. Alternatively, it is also possible to store past states such as the state in the last time or the state in the time before last in multiple key depressions, and hold the current value as a value to be held only when any or all of the difference between the current value and the previous value, the movement average or the movement dispersion are within a predetermined range.

Next, the CPU 45 calculates and stores the speed of the stroke section (between the detection sections SWs adjacent to each other) (step S103). Since the design stroke sST21 between the detection sections SW1 and SW2 is reliable, the key depression speed V21 between the detection sections SW1 and SW2 is calculated from V21=sST21/rT21 using the time difference rT21 and the stroke sST21. It should be noted that the key depression speeds V31 and V32 may also be calculated.

Next, the CPU 45 determines whether the key depression stroke has ended (step S104). For example, it can be determined that the key depression stroke has ended when the detection section SW3, which is the detection section SW operated last, turns ON. As a result of the determination, in a case where the key depression stroke has not ended (the key depression is in progress), the CPU 45 returns the process to step S101, whereas when the key depression stroke has ended, the CPU 45 uses the information stored in step S102 to calculate a candidate for correction information J (step S105). As the correction information J, there are calculated time correction values calT1, calT2 and calT3, time difference correction values calT31 and calT32, and stroke correction values calST31 and calST32.

That is, the CPU 45 calculates the time difference rT32 from rT32=rT3−rT2 using the time rT3 and rT2. Then, in a case where the key depression speed is Vplay with a constant speed, stroke rST32 is calculated from rST32=rT32×Vplay. On the other hand, in a case where the key depression speed is not Vplay, the stroke rST32 is calculated from rST32=rT32×V21 using the key depression speed V21 and the time difference rT32. Using the stroke rST32, the stroke correction value calST32 is calculated from the above-mentioned Formula 1.

Next, in order to decide whether the key depression operation was appropriate for acquisition of the correction information J, the CPU 45 determines whether the key depression operation satisfies a "predetermined condition" (step S106). In this respect, examples of the predetermined condition include a condition in which the key depression speed V21 is within a predetermined range. However, the present invention is not limited to this. For example, the predetermined condition may include a condition in which any or all of the key depression speeds V21, V31, and V32 fall within the predetermined range. Alternatively, in place of the decision on the basis of the key depression speed, or in addition to the determination on the basis of the key depression speed, the predetermined condition may include a condition in which a key depression acceleration falls within the predetermined range. In that case, in step S103, the key depression acceleration is calculated from the key depression speed of the two sections or by the integral calculation of the key depression speed, and the decision in step S106 is made on the basis of the calculated key depression acceleration.

As a result of the determination in step S106, in a case where the key depression operation does not satisfy the predetermined condition, the CPU 45 discards the correction information J obtained as a candidate (step S109) and returns the process to step S101. On the other hand, in a case where the key depression operation satisfies the predetermined condition, the CPU 45 determines that the correction information J obtained as a candidate is officially employed, and causes the memory 57 to store it (step S107). As a result, the correction information J is derived and stored (FIGS. 5A and 5B). Further, various parameters (strokes rST32 and rST31, deviation Δd, designation of the silencing trigger SW) are calculated on the basis of the correction information J that has been employed and causes the memory 57 to store them (step S108) (FIG. 5A). Thereafter, the process in FIG. 8 is terminated.

It should be noted that the process in FIG. 8 is not limited to the key depression stroke. It may be executed during the key release stroke. Further, in a case where the process in FIG. 8 can be executed by key depression at a controlled speed by a mechanism for operating the key K at a constant speed, the process in steps S106 and S109 may be omitted.

Figure 9:
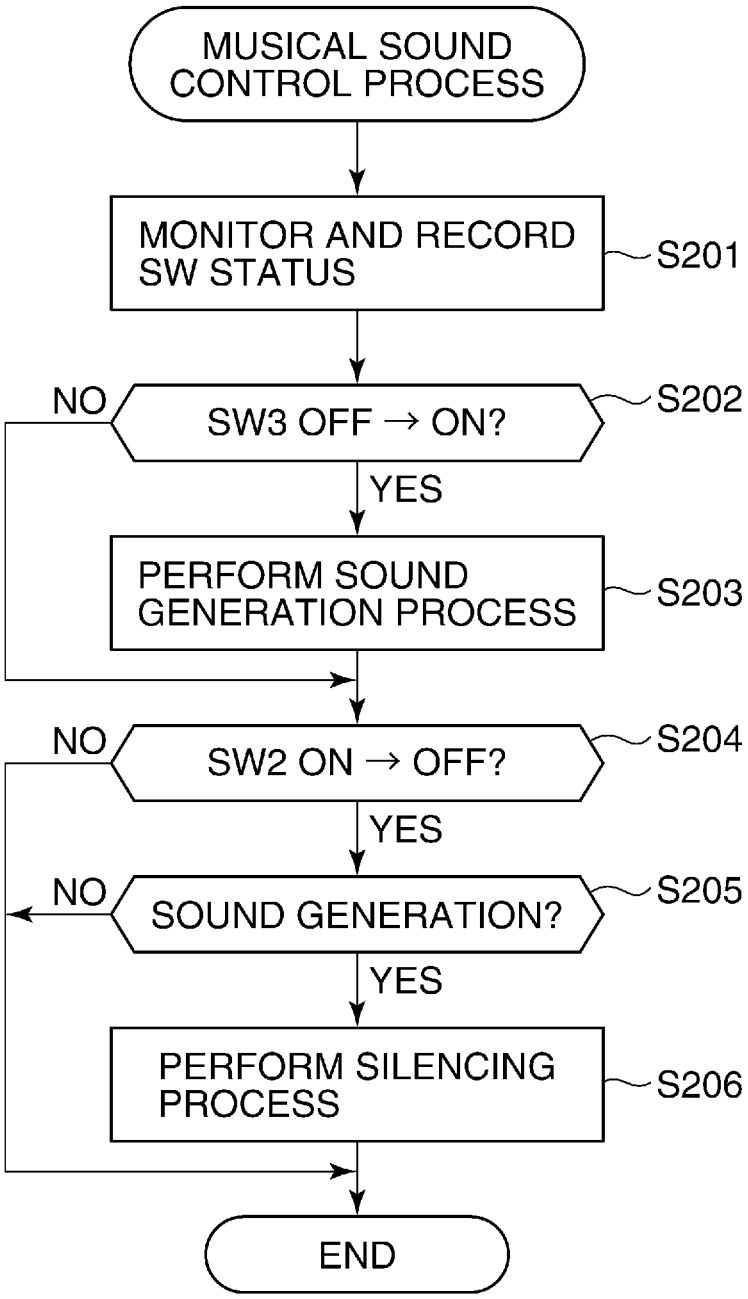
FIG. 9 is a flowchart showing a musical sound control process.

FIG. 9 is a flowchart a showing musical sound control process. This process is started when preparation for performance in the silencing mode is completed and is executed at predetermined time intervals (for example, every 100 μsec). It should be noted that the musical sound control can be performed on the basis of the detection results by the plurality of detection sections SW. In addition, the detection results by these detection sections SW are not limited to be used for musical sound control, and can also be used to record performance as performance data for musical sound control. There is no limit to the number of detection sections SW used for musical sound control and performance data recording. Here, control using three detection sections SW1, SW2, and SW3 will be exemplified.

First, the CPU 45 scans the states of the detection sections SWs for each key K, and stores the scanning result (ON or OFF) and the change in state (the presence or absence of switching between ON and OFF, time of change) in the register for each key K (Step S201). As a result, the information on the detection result (FIG. 4B) is stored for each key K and is updated as needed. It should be noted that a process of scanning each state by the detection section SW and a process of storing the state in the register may be automatically performed sequentially by hardware.

Next, the CPU 45 determines whether the detection state of the detection section SW3 has switched from OFF to ON (step S202). As a result of the determination, in a case where the detection state of the detection section SW3 has switched from OFF to ON, the CPU 45 executes a sound generation process for each key K (step S203) and advances the process to step S204. On the other hand, in a case where the detection state of the detection section SW3 has not switched from OFF to ON, the process proceeds to step S204 without performing the sound generation process.

In this sound generation process, the CPU 45 generates musical sound information, and at the same time, decides the sound generation timing and the key depression velocity. First, for the key depression velocity, the CPU 45 calculates the time difference rT32 from rT32=rT3−rT2 (see FIGS. 6B and 6C) and acquires the stroke rST32 by reading it from the database (FIG. 5A) or by calculating it from the correction information J. Then, the CPU 45 calculates and determines the key depression speed V32 as the key depression velocity according to the above-mentioned Formula 3.

In addition, for the sound generation timing, as described above, the CPU 45 calculates the delay time ΔT from ΔT=ΔD/V32, and determines the timing of T3+ΔT as the sound generation timing (see FIG. 7A). Then, the CPU 45 starts sound generation on the basis of the generated musical sound information at the determined key depression velocity and sound generation timing. In other words, the CPU 45 controls the sound source circuit 53, the effect circuit 54, and the like to generate a musical sound with the pitch of the key K to be processed this time at the currently determined velocity and sound generation timing for the key K.

Next, the CPU 45 determines whether the detection state of the detection section SW2 has switched from OFF to ON (step S204). As a result of the determination, the CPU 45 ends the process in FIG. 9 without performing a silencing process in a case where the detection state of the detection section SW2 has not switched from OFF to ON. On the other hand, in a case where the detection state of the detection section SW2 has switched from ON to OFF, the CPU 45 determines whether the pitch corresponding to the key K to be processed this time is being sounded (step S205), and if not, ends the process in FIG. 9, whereas if so, executes the silencing process of the musical sound being sounded (step S206).

In this silencing process, the CPU 45 decides the key release velocity and the silencing timing. First, for the key release velocity, the CPU 45 calculates the time difference rT23 from rT23=rT2−rT3 (see FIGS. 7B and 7C) and acquires the stroke rST32 by reading it from the database (FIG. 5A) or by calculating it from the correction information J. Then, the CPU 45 calculates and determines the key depression speed V23 as the key release velocity according to the above-mentioned Formula 4.

In addition, for the silencing timing, as described above, the CPU 45 calculates the delay time ΔT from ΔT=Δd/V23, and determines the timing of T2+ΔT as the silencing timing (see FIGS. 7B and 7C). Then, the CPU 45 starts silencing of the musical sound which is being sounded at the determined key release velocity and silencing timing, followed by terminating the process in FIG. 9.

According to the present embodiment, on the basis of the detection timing (rT2) by the detection section SW2, the detected key depression speed (V21), and the detection timing (rT3) by the detection section SW3 in a case where the key is depressed in the derivation mode, after the rST32 value is calculated, the stroke correction value calST32 is derived as the correction information J and stored in the memory 57. In the performance mode, the musical sound is controlled on the basis of the detection timing by the detection sections SW1, SW2, and SW3 and the stroke correction value calST32. As a result, variations in the detection mechanism can be corrected so that appropriate musical sound control can be performed.

In addition in the derivation mode, the correction information J is calculated on the basis of the rT2 value, the rT3 value, and the V21 value in the operation stroke in which the operation speed (or the operation acceleration) of the key is within a predetermined range, so that correction Information with high reliability can be derived.

In addition, in the sound generation control, since the sound generation is started at the timing (T3+ΔT) obtained by correcting the detection timing of the detection section SW3 used for the sound generation trigger to a delay side on the basis of the correction information J, appropriate sound generation control can be performed. In addition, in the silencing control, since the silencing is started at a timing (T2+ΔT) obtained by correcting the detection timing of the detection section SW2 used for the silencing trigger to a delay side on the basis of the correction information J, appropriate silencing control can be performed.

In addition, since the shutter member 121 is integrally formed, the reliability of the distance (sST21) between the two detection positions of the first boundary 123 and the second boundary 124 is high, and the time difference rT21 and the time difference sT21 substantially coincide with each other, a highly reliable key depression speed V21 can be obtained from the sST21 value and the rT21 value.

It should be noted that the derivation mode can also be performed in the performance mode. To give an example, for example, in a case where the derivation mode is performed in the performance mode, the correction information J is derived before the musical sound is controlled, and the correction information J is reflected in the musical sound control in the performance mode. In this case, since the musical sound control is performed in real time while the correction information J is derived as needed, it is not necessary to store the correction information J. It should be noted that the correction information J derived in the performance mode may be stored so that the correction information J can be used for musical sound control in the subsequent performance modes.

It should be noted that when deriving the correction information J, the detection result of the key K except for the hammer 11 was used for the detection timing and speed to be used. However, there is not restriction in the combination of the key K and the hammer 11, and it is not indispensable that one member is the key K. That is, the combination may be employed as long as a configuration includes a first detection unit for detecting at least a position and a speed of the key K or a first member out of a displacement member, and a second detection unit for detecting at least a position of a second member other than the first member among displacement members.

It should be noted that the detection section SW used for the correction information storage process in the derivation mode and the detection section SW used for musical sound control need not completely match with each other. In addition, while the number of detection sections SW used for musical sound control is three, it may be four or more. Furthermore, in musical sound control, any combination out of the plurality of detection sections SW may be used for calculating the velocity of key depression and/or key release. In a case where the detection results by a large number of detection sections SW can be used, it is preferable to determine the velocity of key depression/release on the basis of the detection timing at two detection positions not adjacent to each other out of the plurality of detection positions sequentially detected by the plurality of detection sections SW. At this time, the velocity of key depression/release may be determined on the basis of the detection timing at two detection positions not adjacent to each other out of the detection positions detected by the detection sections SW detecting the operation of the key K. Alternatively, the velocity of key depression/release may be determined on the basis of the detection timing at two detection positions not adjacent to each other out of the detection positions detected by the detection sections SW detecting the operation of the displacement member. Since the time interval between adjacent detection positions is short, by employing a combination of the detection timings of the detection sections SW having long time intervals, the accuracy with which the key velocity is determined is enhanced.

It should be noted that not all of the detection sections SW shown in FIG. 1 and FIG. 2, etc. are necessary. For example, in a case where the correction information storage process can be performed at the controlled key depression speed, one detection section SW capable of detecting the position of both the key K and the hammer 11 may be provided at a minimum.

It should be noted that in the correction information storage process, as an operation mode of the managed key K, the key depression at the key depression speed Vplay with a constant speed is exemplified. The present invention is not limited to this. The operation speed and the speed change of the key K may be predetermined operation modes. That is, in the pre-shipment stage, or the like, the amount of designed values (time T1, T2, and T3, time difference T31, T32, and T21, etc.) is obtained in advance in a predetermined operation mode. The predetermined operation mode may not have a constant speed as long as the same operation mode as the then operation can be reproduced in the correction information storage process in the derivation mode.

In a case where a large number of detection sections SW are provided, the detection section SW used for musical sound control may be selected on the basis of the stroke rST, which will be described below with reference to FIGS. 10A and 10B.

Figure 10A:
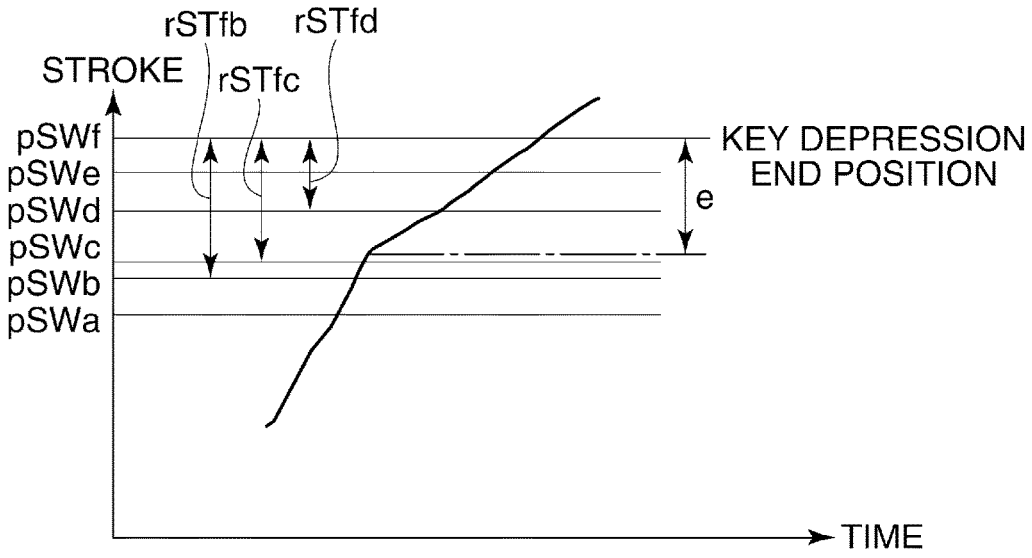
FIG. 10A and FIG. 10B are diagrams showing the relations between time and key stroke in the key depression/release stroke.
Figure 10B:
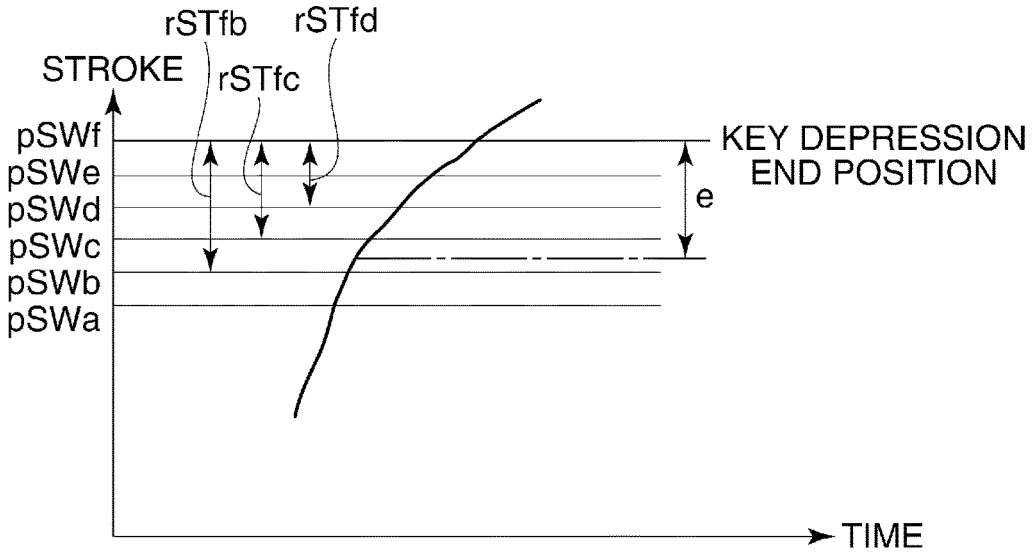

FIG. 10A and FIG. 10B are diagrams showing the relations between time and key stroke in the key depression/release stroke. The meaning of the horizontal axis and the vertical axis is the same as those in FIGS. 6A to 6C. The plurality of detection sections SWa to SWf are disposed at positions where objects are sequentially detected at the detection positions pSWa to pSWf. In this respect, the order of the detection positions pSWa to pSWf is a detection order specified in a case where it is assumed that the key K and the displacement member are interlocked. The CPU 45 converts the detection positions pSWa to pSWf into the stroke positions of the key K, and performs musical sound control on the basis of the converted stroke positions. The position to which the key K returns from the detection position pSWf by a distance e in the non key depression direction corresponds to an escapement position at which the jack 6 escapes from the hammer roller 14. The distance e is acquired before product shipment and stored in the memory 57, the ROM 46, or the like. The stroke corresponding to the detection timing difference between the detection position pSWf and the detection position pSWd is a stroke rSTfd. Similarly, the stroke corresponding to the detection timing difference between the detection position pSWf and the detection position pSWc is a stroke rSTfc, and the stroke corresponding to the detection timing difference between the detection position pSWf and the detection position pSWb is a stroke rSTfb.

Due to aging, deformation such as warping of the key K and the displacement member, which and objects, may occur. Hence, the detection timing by the detection section SW for detecting the position of these objects changes. For example, suppose that the state of the detection positions pSWa to pSWf, which were in the state shown in FIG. 10A at the time of delivering the product, have become the state as shown in FIG. 10B due to long-term use of the product. Although, in FIG. 10A, the escapement position was located between the stroke rSTfd and the stroke rSTfc, it is located between the stroke rSTfc and the stroke rSTfb in FIG. 10B.

Normally, friction increases mechanically at the escapement position, so that a slight change in the key depressing force causes a large change in the key depression speed in the vicinity of the escapement position. Thus, since the reliability of the detection result detected near the escapement position is not so high, it is preferable not to use the detection result for musical sound control.

Therefore, the detection results at the two detection positions sandwiching a position corresponding to the escapement position may be excluded from the detection result used for musical sound control. In particular, it is preferable not to use it to calculate the velocity. For example, in the example of FIG. 10A, the detection results at the detection position pSWc and the detection position pSWd by the detection sections SWc and SWd are not used. In the example of FIG. 10B, detection results at the detection position pSWb and detection position pSWc by the detection sections SWb and SWc are not used. Thus, it is possible to prevent the detection result with a large deviation from being used for musical sound control.

In the embodiments described above, although application of the present invention to a keyboard musical instrument having the grand piano type action mechanism ACT is taken as an example, the configuration of the keyboard musical instrument according to the present invention is not limited to such a configuration having the action mechanism ACT. In other words, the key depression operation may merely have a displacement member that is moved by the key depression operation and may not be required to have the action mechanism.

Figure 11:
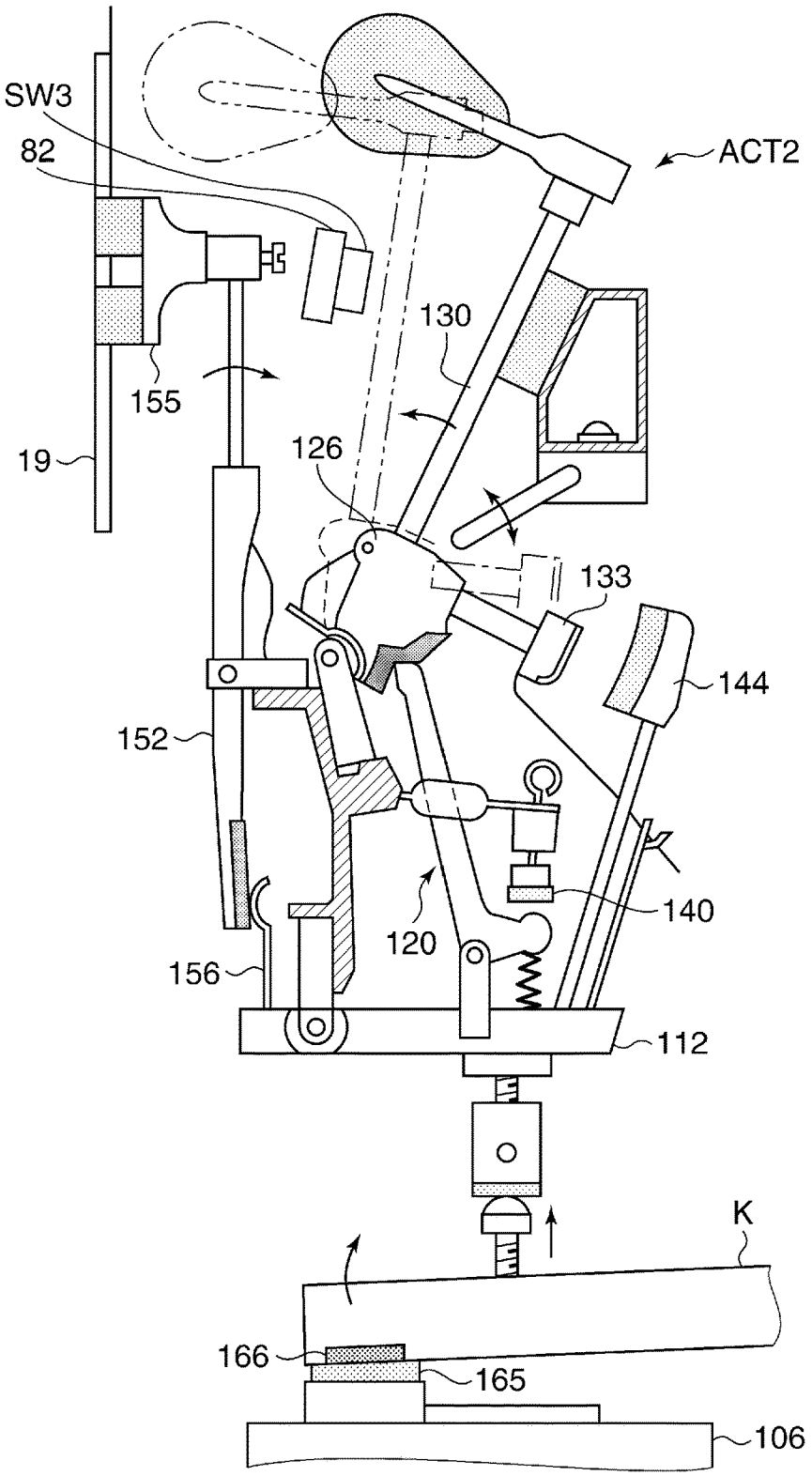
FIG. 11 is a side view of an action mechanism of an upright piano.

In addition, the present invention is also applicable to a keyboard musical instrument having an upright type action mechanism ACT shown in FIG. 11.

FIG. 11 is a side view showing an action mechanism ACT2 of an upright piano. In normal key depression operation, when the key K is depressed down, a wippen 112 is pushed up and turned, whereby a jack 120 is raised. In addition, when the jack 120 is raised, a bat 126 is pushed up by the jack 120, whereby a hammer 130 is turned counterclockwise as shown in FIG. 11. The jack 120 is raised and turned. In the middle of being raised and turned, the jack 120 comes into contact with a regulating button 140 and is turned clockwise, thereby moving temporarily away from the lower portion of the bat 126. In addition, when the wippen 112 is raised and turned, a damper spoon 156 turns a damper lever 152 clockwise, whereby a damper 155 is spaced away from the string 19.

After the damper 155 is spaced away from the string 19, the hammer 130 strikes the string 19. The hammer 130 is then bounced back, and a catcher 133 is elastically received by a back check 144. The jack 120 is released from the regulating button 140 by the turning and lowering of the wippen 112 accompanied by the key release operation, so that the jack 120 is turned and then returned to its original position, and the upper end of the jack 120 again enters the lower portion of the bat 126. Hence the next string striking action can be carried out using the same key K. A key back rail cloth 165 is disposed so as to be fastened to a shelf board 106, and a conductive unit 166 is provided at the rear lower portion of the key K. Like the silencing stopper 60, a silencing stopper 82 is configured so that its position can be switched for use in the silencing mode.

In the above-mentioned configuration, for example, the silencing stopper 82 may be provided with the detection section SW3. The detection sections SW may be provided between the bat 126 and the jack 120, between the regulating button 140 and the jack 120, between the lower surface (conductive unit 166 thereof) of the key K and the key back rail cloth 165, and the like.

Although the present invention has been described above on the basis of the preferred embodiments thereof, the present invention is not limited to these specific embodiments. Various embodiments within the scope not departing from the gist of the present invention are also included in the present invention.

This application is a bypass continuation application of PCT International Application PCT/JP2016/083005, filed on Nov. 1, 2016, which is based on and claims priority from Japanese Patent Application No. 2015-216746, filed on Nov. 4, 2015, the entire contents of which are incorporated herein by reference.

What is claimed is:

1. A keyboard musical instrument comprising:

a key;

displacement members that are directly or indirectly driven and moved by the key due to a depression operation of the key;

a first detection unit configured to detect at least a position and a speed of the key or a first member out of the displacement members;

a second detection unit configured to detect at least a position of a second member other than the first member out of the displacement members;

a storage unit configured to store correction information;

a derivation unit configured to derive the correction information as an amount to be used for correcting a deviation with respect to a designed value of a physical quantity used for musical sound control on the basis of a detection timing of the position by the first detection unit, the speed detected by the first detection unit, and a detection timing of the position by the second detection unit in a case where the key is operated in a derivation mode, and cause the storage unit to store the correction information; and a musical sound control unit configured to control a musical sound on the basis of the detection timing of the position by the first detection unit, the detection timing of the position by the second detection unit, and the correction information stored in the storage unit in a performance mode.

2. The keyboard musical instrument according to claim 1, wherein the derivation unit determines whether an operation speed of the key is within a predetermined range on the basis of the speed detected by the first detection unit in an operation stroke in which the key is operated in the derivation mode, and the derivation unit derives the correction information on the basis of the detection timing of the position by the first detection unit, the speed detected by the first detection unit, and the detection timing of the position by the second detection unit in the operation stroke in which the derivation unit determines that the operation speed of the key is within the predetermined range.

3. The keyboard musical instrument according to claim 1, wherein the first detection unit further detects an acceleration of the first member, and wherein the derivation unit determines whether an operation acceleration of the key is within a predetermined range on the basis of the acceleration detected by the first detection unit in the operation stroke in which the key is operated in the derivation mode, and the derivation unit derives the correction information on the basis of the detection timing of the position by the first detection unit, the speed detected by the first detection unit, and the detection timing of the position by the second detection unit in an operation stroke in which the derivation unit determines that the operation acceleration of the key is within the predetermined range.

4. The keyboard musical instrument according to claim 1, wherein the position detected by the second detection unit includes a detection position used for a sound generation trigger, and wherein the musical sound control unit performs control to start a sound generation at a timing obtained by correcting a detection timing at the detection position used for the sound generation trigger on a delay side on the basis of the correction information.

5. The keyboard musical instrument according to claim 1, wherein the first detection unit is capable of detecting the first member at at least two detection positions, and wherein the musical sound control unit decides a detection position to be used for a silencing trigger out of the two detection positions on the basis of the detection timing at the two detection positions by the first detection unit and the correction information, and performs control to start silencing at the detection timing at the determined detection position.

6. The keyboard musical instrument according to claim 1, wherein the position detected by the first detection unit includes a detection position used for a silencing trigger, and wherein the musical sound control unit performs control to start silencing at a timing obtained by correcting a detection timing at the detection position used for the silencing trigger on a delay side on the basis of the correction information.

7. The keyboard musical instrument according to claim 1, wherein the musical sound control unit decides a key velocity on the basis of a detection timing at two detection positions not adjacent to each other out of a plurality of detection positions detected by the first detection unit or a detection timing at two detection positions not adjacent to each other out of a plurality of detection positions detected by the second detection unit.

8. The keyboard musical instrument according to claim 1, wherein the speed detected by the first detection unit is decided on the basis of a distance between two detection positions defined by an integrally formed member and a time difference between detection timings at the two detection positions.

9. The keyboard musical instrument according to claim 1, wherein the musical sound control unit converts a plurality of detection positions sequentially detected by any one or both of the first detection unit and the second detection unit into a stroke position of the key, and performs the musical sound control on the basis of the converted stroke position, and wherein the musical sound control unit excludes from detection results used for the musical sound control detection results at two detection positions, sandwiching a position corresponding to an escapement position where a jack escapes from a hammer roller, out of a plurality of detection positions of which detection order is specified in a case where it is assumed that the key and the displacement member are interlocked with each other.

10. The keyboard musical instrument according to claim 1, wherein the physical quantity used for the musical sound control includes a movement stroke of the key moving between detection timings of positions detected by the first detection unit and/or the second detection unit.

11. The keyboard musical instrument according to claim 1, wherein the derivation mode is capable of being performed in the performance mode.

12. A method of acquiring correction information in a keyboard musical instrument, wherein the keyboard musical instrument includes a key, displacement members that are directly or indirectly driven and moved by the key due to a depression operation of the key, a first detection unit configured to detect at least a position of the key or a first member out of the displacement members, a second detection unit configured to detect at least a position of a second member other than the first member out of the displacement members, a storage unit configured to store correction information, and a musical sound control unit configured to control a musical sound on the basis of a detection timing of the position by the first detection unit, a detection timing of the position by the second detection unit, and the correction information stored in the storage unit in a performance mode, the method comprising:

deriving the correction information as an amount to be used for correcting a deviation with respect to a designed value of a physical quantity used for musical sound control on the basis of the detection timing of the position by the first detection unit, and the detection timing of the position by the second detection unit in a case where the key is operated in a predetermined operation mode in which an operation speed and a speed change are defined in a derivation mode, and causing the storage unit to store the correction information.

13. A method of acquiring correction information in a keyboard musical instrument, wherein the keyboard musical instrument includes a key, displacement members that are directly or indirectly driven and moved by the key due to a depression operation of the key, a first detection unit configured to detect at least a position and a speed of the key or a first member out of the displacement members, a second detection unit configured to detect at least a position of a second member other than the first member out of the displacement members, a storage unit configured to store correction information, and a musical sound control unit configured to control a musical sound on the basis of the detection timing of the position by the first detection unit, the detection timing of the position by the second detection unit, and the correction information stored in the storage unit in a performance mode, the method comprising:

deriving the correction information as an amount to be used for correcting a deviation with respect to a designed value of a physical quantity used for musical sound control on the basis of a detection timing of the position by the first detection unit, the speed detected by the first detection unit, and a detection timing of the position by the second detection unit in a case where the key is operated in a derivation mode, and causing the storage unit to store the correction information.

* * * * *